United States Patent [19]

Goldfarb et al.

[11] 4,309,030

[45] Jan. 5, 1982

[54] ELECTRONIC COMPETITIVE PLAYER RESPONSE GAME APPARATUS

[75] Inventors: Adolph E. Goldfarb, 4614 Monarca Dr., Tarzana, Calif. 91356; Stephen C. Beck, Berkeley, Calif.

[73] Assignee: Adolph E. Goldfarb, Tarzana, Calif.

[21] Appl. No.: 121,647

[22] Filed: Feb. 14, 1980

[51] Int. Cl.[3] ..... A63B 71/06; A63F 9/00

[52] U.S. Cl. ..... 273/1 GC; 273/1 E; 273/85 G; 273/313

[58] Field of Search ..... 273/1 R, 1 GC, 1 GE, 273/1 E, 85 R, 85 G, 237, 313

[56] References Cited

U.S. PATENT DOCUMENTS 4,147,350 4/1979 Usami ..... 273/1 GC 4,249,744 2/1981 Bromley ..... 273/313

4,261,563 4/1981 Goldfarb ..... 273/1 GC

*Primary Examiner*—Russell E. Adams

*Attorney, Agent, or Firm*—Romney, Golant, Disner & Ashen

[57] ABSTRACT

Disclosed is a presently preferred embodiment of an electronic competitive player response game apparatus having at least three and preferably four player stations. Each of the disclosed stations is provided with a lamp for designating which one of the stations is "active," and with a set of push button switches for permitting a player, when his station is active, to select the next active station by the timely actuation of the proper switch. The disclosed apparatus is also provided with a game start switch for causing the commencement of a game round, and with electronic circuitry for controlling the game's progress.

30 Claims, 17 Drawing Figures

Fn (D, INPUT)

| | $C_1$ | $C_2$ | $C_3$ | $C_4$ |
|---|---|---|---|---|
| $A_2$ | $D_1$ | $D_2$ | $D_3$ | $D_\emptyset$ |
| $A_1$ | $D_2$ | $D_3$ | $D_\emptyset$ | $D_1$ |
| $A_\emptyset$ | $D_3$ | $D_\emptyset$ | $D_1$ | $D_2$ |

WAIT FOR FLAG = OFF
186
BOUNCE
188
OFF
TURN OFF LAMP NO. D
190
D=Fn (D, INPUT)
192
|[Pm]| = 1?
194
YES
NO
198
208
D≤[Pm]?
NO
CALL RAZZ
200
202
204
YES
222
SET NOF1 = NOF2
SCORE = SCORE+1
NOF2 = 0
206
220
208
WAIT FOR FLAG = ON OR PLAYER D INPUT
BOUNCE
214
INPUT
ON
SET NOF2 = NOF2 + 1
212
LIGHT LAMP NO. D
216
CALL RAZZ
210
218
WAIT FOR FLAG = OFF OR PLAYER D INPUT
BOUNCE
NO
YES
NOF2 = NOF1?
OFF
INPUT
220
224
234
NO
|[Pm]| = 1?
YES
D = 0?
226
228
YES
NO
232
242
CALL RAZZ
YES
SCORE = 10?
SET D = 0?
240
NO
236

"WAIT LOOP"

356
FINAL ROUND OR SOLO GAME? /[Pm]/ = 1?
YES
358
NO
SCORE = SCORE + 1
360
368
NO
SCORE = 10?
362
357
YES
364
GO TO "NEXT ROUND"
CALL RAZZ
366
END

416
FROM FIG. 12A.
414
SERVE = YES?
YES
418
NO
420
RANDOM SELECTION COMINPUT = YES OR NO
NO
YES
422
432
BOUNCE
WAIT FOR FLAG OFF
SET SERVE = NO
SET NS = NS+1
424
426
TURN OFF LAMP NO. D
428
RANDOM SELECTION D=0 OR 1
BOUNCE
WAIT FOR FLAG = ON
436
430
TURN ON LAMP NO. D
GO TO "NEXT"

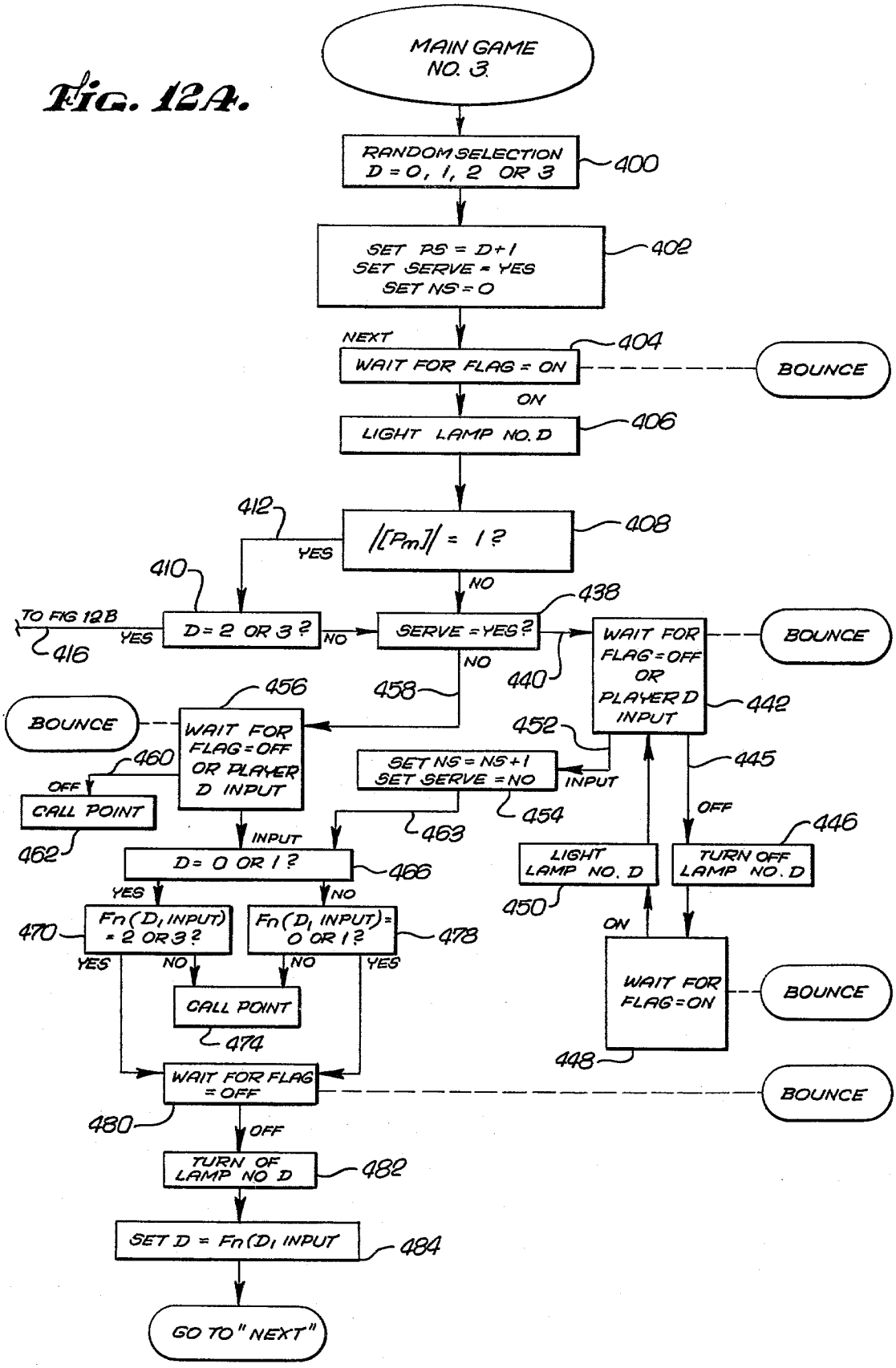
FIG. 12A.
MAIN GAME NO. 3
RANDOM SELECTION D = 0, 1, 2 OR 3
400
SET PS = D+1
SET SERVE = YES
SET NS = 0
402
NEXT
WAIT FOR FLAG = ON
404
BOUNCE
ON
LIGHT LAMP NO. D
406
412
|[Pm]| = 1 ?
408
YES
410
NO
TO FIG 12B
D = 2 OR 3 ?
YES
NO
416
SERVE = YES ?
438
WAIT FOR FLAG = OFF OR PLAYER D INPUT
BOUNCE
440
442
NO
458
456
BOUNCE
WAIT FOR FLAG = OFF OR PLAYER D INPUT
452
SET NS = NS + 1
SET SERVE = NO
INPUT
445
460
OFF
CALL POINT
462
454
463
OFF
446
INPUT
D = 0 OR 1 ?
466
LIGHT LAMP NO. D
TURN OFF LAMP NO. D
YES
NO
450
470
Fn(D, INPUT) = 2 OR 3 ?
Fn(D, INPUT) = 0 OR 1 ?
478
ON
YES
NO
NO
YES
WAIT FOR FLAG = ON
BOUNCE
CALL POINT
474
448
WAIT FOR FLAG = OFF
BOUNCE
480
OFF
TURN OF LAMP NO D
482
SET D = Fn(D, INPUT
484
GO TO "NEXT"

POINT
500
D = 0 OR 1?
502
YES
NO
506
504
T2 = T2 + 1
T1 = T1 + 1
508
510
T = T2
T = T1
512
T1 + T2 = 7?
514
YES
518
NO
516
T1 * T2 = 0?
YES
NO
522
S = 3?
530
YES
NO
529
524
T = 21?
T = (S+1) * 4+3?
526
519
YES
NO
YES
NO
532
528
520
SET SPREAD = T1 - T2
538
CALL SERVER
522
SPREAD > 1?
YES
NO
SPREAD < -1?
YES
532
FLASH SPREAD ON D=0 AND D=1
FLASH SPREAD ON D=2 AND D=3
RETURN TO "NEXT"
540
536
END

ELECTRONIC COMPETITIVE PLAYER RESPONSE GAME APPARATUS

FIELD OF THE INVENTION

The present invention relates generally to apparatus for playing a game of skill and more particularly to electronic game apparatus having successively designated activated stations for playing a competitive response game, at least one of the stations being under the manual control of a player, wherein the player at an active manually controlled station must make a proper physical response before his station becomes inactive.

BACKGROUND OF THE INVENTION

A traditional children's game is commonly known as "hot potato". The game is typically played by several players arranged facing one another about a circle. A ball, a bean bag or other object simulating a hot potato is quickly passed from one player to another, who in turn passes it to a third, etc. If a player does not catch the object when thrown to him and quickly pass it on, but rather fumbles or drops the object, he drops out of play and the game continues with one less player until all but the winner have been eliminated. The game is sometimes accompanied by music, in which case the player holding the object when the music stops is also eliminated.

For a variation of the "hot potato" game, there has been provided toy apparatus having the appearance of a potato or of a bomb and comprising a wind-up motor or other timing mechanism. Such an apparatus was tossed from player to player; the loser was the player who missed or dropped it before it went off, or the one holding it when it went off.

Apparatus also has been known for playing a game of skill wherein a plurality of players arranged around a circle faced a rotating target in the center of the circle. The object of the game was to shoot a projectile into the opening on the target while the target was facing that player.

In another somewhat similar type of game, the apparatus employed as the target was in the shape of a mouth which opened and closed randomly. In order to score, the projectile had to be shot at the target while open.

Electronic apparatus has been in use in public amusement arcades for playing a simulated game of table tennis on a video screen and related apparatus has been sold commercially in the form of adaptors which may be connected to home television sets. A simulated ball in the form of a bright area moves back and forth from one side to the other of a T-V type screen. If it touches the top or bottom boundary of the screen, it is deflected respectively downwards or upwards towards the screen center while at the same time maintaining its forwards or backwards motion. Each player is provided with one simulated paddle in the form of a bright vertical line which may be moved up and down at the respective left or right edge of the screen. If the path of the simulated ball's motion intersects the simulated paddle respective side, the simulated ball is reflected back to the center of the screen, rather than passing off the screen's respective side edge. A variation of such game apparatus utilizes a liquid crystal matrix type of display rather than a T-V type screen. In that case, the ball is simulated by making one square of the matrix dark (non-reflective) while the surrounding background is light (reflective). Such simulated table tennis games have sometimes been provided with a skill select switch that may be manually set by the players and which may, for example, increase or decrease the size of the simulated paddle or make the simulated ball move faster or slower.

However, such games and their associated apparatus were limited in play value; the players would not play more than a few rounds of the game before beginning to lose interest.

Such was especially the case after the players had played the prior art games enough times that they had acquired the necessary skill always to catch and toss the object from player to player or always to aim and shoot the playing piece into the target or always to move the simulated paddle into a position where it intercepts the path of the simulated moving ball.

Accordingly, a primary object of the present invention is to provide playing apparatus for playing a game of skill that is challenging, satisfying and has a high degree of play value.

It is another related object of the present invention to provide game apparatus that retains a player's interest even after he has played the game many times.

Another object of the present invention is to provide game apparatus adapted to be used by several players concurrently who are engaged in playing a challenging game of skill against one another.

It is a more specific objective of one aspect of the present invention to provide electronic game apparatus employing visible lights simulating a bouncing ball to indicate which of the players must pass or hit the ball and when, wherein the lights flash on and off at a predetermined rate and wherein no more than one of the lights is on at any given time.

It is an objective of another specific aspect of the present invention to provide electronic game apparatus usable in a solo mode by a single player, said apparatus having (a) a first player control station provided with a manual response switch activatable by the player and with a visible light for signalling to the player when his station is active and actuation of said manual switch would be timely, (b) a second station under automatic control which is also provided with a visible light for signalling to the player at the first station when the second (automatic) station is active, and (c) electronic game control means which simulates the passing or hitting of the light from one station to another when said response switch is timely actuated by the player, by (1) causing said visible light signalling means associated with said second (automatic) station to indicate the said second station is active, and (2) causing the light to be automatically passed on from said second station in accordance with the rules of the game.

It is a further objective of one specific aspect of the present invention to provide electronic game apparatus usable by several players, each player having his own player control station provided with visible light signaling means for signalling to the player when the station is active and a manual switching means for selecting other player stations, as well as electronic game control and timing means which, when a second station is timely selected at a first active station, causes said second station to then become active and the game to proceed.

A further, more specific objective of the present invention is to provide electronic game apparatus which generates a regular rythmn (corresponding to the simulated bouncing of a simulated ball) and which speeds up the rythmn as a round or volley within the game proceeds, thereby additionally adding further interest to the game.

It is yet a further objective of the present invention to provide game apparatus wherein a light regularly flashing on and off is synchronized with audible musical and rythmic sound effects, further emphasizing the steady regular flashing of the light and indicating the precise moment at which it is turned on and at which it is turned off.

Another objective of one specific aspect of the present invention is to provide electronic game apparatus for playing a game wherein, when a light at a player's station is lit, the player must pass to another station by actuating an appropriate response switch. The player's failure to actuate the switch when (and only when) the light is on results in the player losing the current round or volley of the game.

Another specific objective of the present invention is to provide electronic game apparatus for playing a multi-round game wherein a player who fails to "pass" a simulated "ball" in accordance with the rules of the game is disqualified from participating in further rounds within the same game.

Yet another specific objective is to provide apparatus of the type described wherein the bounce tempo is also made audible, with different rhythmic sequences of musical tones provided for different games and/or skill levels.

Yet another specific objective of the present invention is to provide electronic game apparatus intended to simulate the game of table tennis capable of being used by two teams of players, each team controlling two lights each simulating a different location of the ball and each having an active state and an inactive state, only one of the four simulated ball locations being active at any given moment in time; the team that has control of the then active ball location has the capability to hit the ball by causing a selected one of the other team's simulated ball locations to assume its active visible state, the hitting or missing of the ball being a function of whether a response switch associated with the balls present location is timely or untimely actuated.

SUMMARY

In accordance with a presently preferred embodiment of the present invention, the foregoing objectives (and other related objectives which will become apparent upon reading of the Detailed Description of a Preferred Embodiment which follows), are satisfied by a new and useful game apparatus having three or preferably four player stations. Each of the stations is provided with a lamp for designating visibly to the players which one of the stations is "active", and with a set of push button switches for permitting, when the station is active, the associated player to select the next active station by the timely actuation of the proper switch. The disclosed apparatus is also provided with a game start switch for causing the commencement of a game round, and electronic circuitry for controlling the game's progress.

In that preferred embodiment, the electronic circuitry (1) establishes a regular "bounce" tempo, each measure simulating one bounce of a ball, (2) determines at what period of time within a single beat the actuation of the player switches is "timely", and at what period of time such actuation is "untimely", and (3) flashes the active station's lamp on at the start of the timely period and flashes it off at the start of an untimely period thereby giving a visual indication to the players which player at which station must actuate his switch and when. The time ratio of "timely" to "untimely" may be present to several different values by means of a skill level control switch. The bounce tempo and the related lamp flashing ratio increases gradually from a slow tempo to a fast tempo during the course of a game round, while maintaining a predetermined ratio of "timely" to "untimely".

Such a preferred embodiment may be used to play several different types of games. In a first game, the simulated bouncing ball is passed around the circle of player stations from one player to the next, the player at an active station having to actuate the proper push button switch at his station after the light has flashed on at his station and prior to its flashing off, in order not to be disqualified from participating in further rounds. The bouncing light is automatically passed on to the next station when it bounces at a station in which there is no participating player. In the game's solo mode, the computer never misses and the human player must successfully pass the bouncing light arriving at his station ten times in a row.

In another game, known as "Pass to Anyone", each player must keep track of which stations are still participating and must select a participating station when he passes the bouncing light. The light may bounce at a particular station more than once. The second player may wait for up to as many bounces as did the first player before he must pass the ball; the third player has up to as many bounces as actually used by the second player, and so on. In the solo mode, the single player must successfully return ten passes from a second station which is under automatic control.

The apparatus may also be utilized to play a simulated game of table tennis, wherein two of the player stations are associated with a first team and the other two with a second team. One player station on the first team controls the ball when it bounces into the lefthand court, the team's other player station controls the ball when it bounces into the righthand court. The two stations on the same team may be operated either by two individual players or by the two hands of a single player. The ball is hit back and forth from one team to the other team until one of the players does not actuate the proper switch in time.

The described preferred embodiment is X-shaped, with four individual egg-shaped player stations at the four outer ends of the "X," each of the stations having a translucent dome surrounding a miniature incandescent light and having a set of three push buttons conveniently located in its interior such that the other players are not able to see which of the three buttons has been pushed. A game start switch as well as game select, number of players and skill level slide switches are contained within a central dome, and the electronics including the power supply and optional loud speaker are all contained within the central portion of X-shaped housing.

In order that the bounce rhythm may be made audible and different rhythmic patterns associated with different games and/or skill levels, the constants used by a "tone generator" are stored in a separate Rhythm table, and may be different for each of twelve different intervals relative to a single bounce or measure.

BRIEF DESCRIPTION OF THE DRAWINGS

For a more complete understanding of the present invention, reference is made to the following Detailed Description of a Preferred Embodiment and the appended Drawings in which.

DETAILED DESCRIPTION OF A PREFERRED EMBODIMENT

Figure 1:
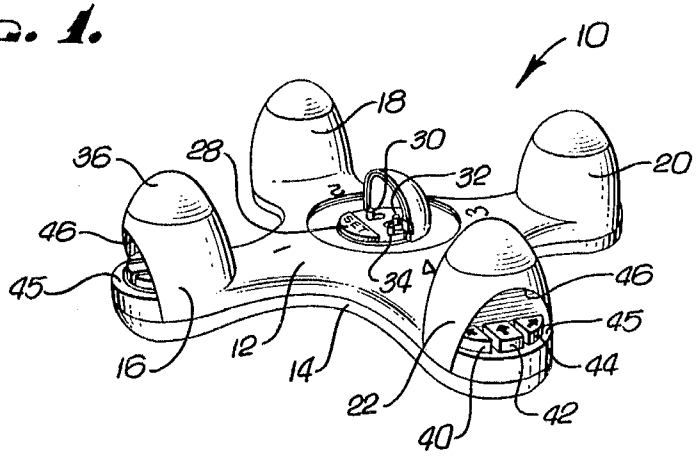
FIG. 1 is a perspective view of a four station apparatus in accordance with a presently preferred embodiment of the present invention specifically adapted for concurrent use by up to four players.

Referring now with particularity to FIG. 1, which shows a four player station version of a preferred embodiment of the present invention, as seen in perspective, it may be seen that in this particular embodiment (which is specifically adapted for the concurrent use of up to four individual players), there is a housing (designated generally by the reference numeral 10) formed generally in the shape of an X comprising a top section 12 and a base section 14, which together define four individual egg-shaped player stations at the outer ends of the four legs of the X, known respectively as station "1" (identified by reference numeral 16), station "2" (reference numeral 18) station "3" (reference numeral 20), and station "4" (reference numeral 22). Centrally located with respect to stations 16, 18, 20 and 22 is a central dome comprising an inner half-hemisphere 24 and an outer half-hemisphere 26 (see also FIG. 3), below which is the game start switch 28 (marked "SET" in the Figure) and three slideably positionable switches (designated respectively 30, 32, and 34) which control respectively the type of game, the number of players, and the skill level (percentage of "On to "Off").

Figure 3:
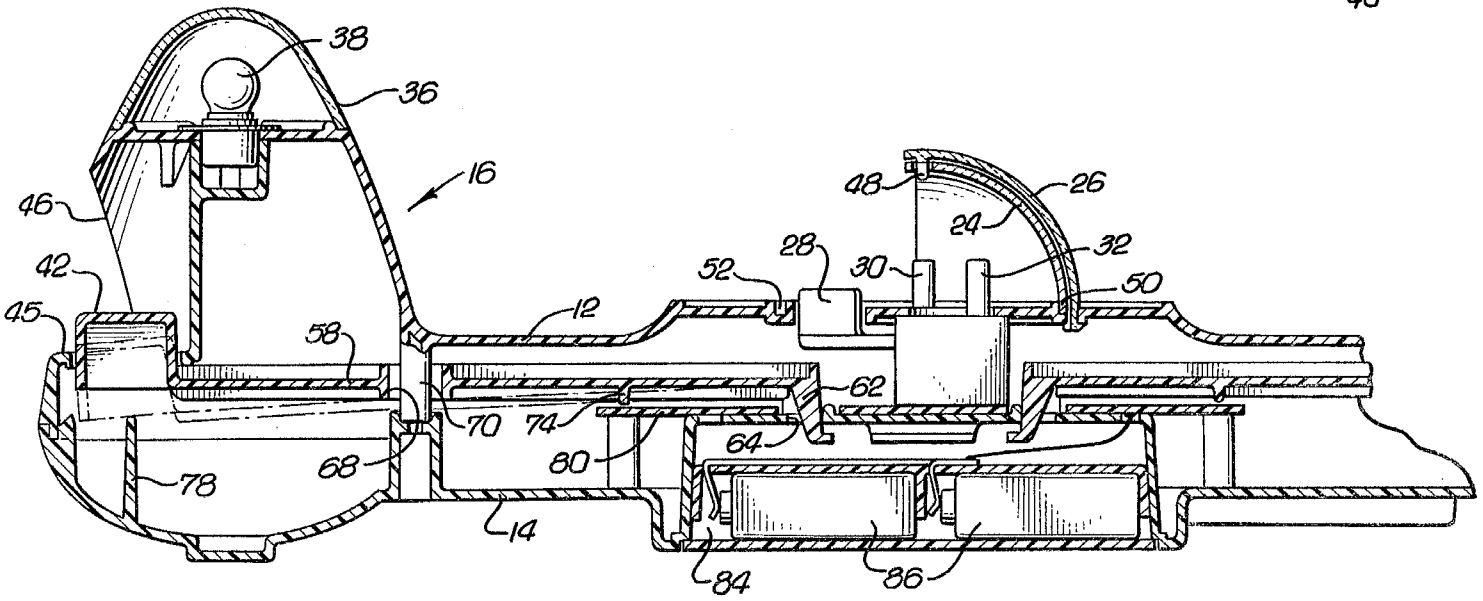
FIG. 3 is a cross-sectional side view taken generally along the lines indicated 3—3 of FIG. 2, and shows the relative location of some of the major components contained within the body of the apparatus.

Above each of the individual player stations is a translucent dome 36 surrounding a miniature incandescent light bulb 38 (see FIG. 3). Also contained within each of the player stations is a left push button 40, a center push button 42, and a right push button 44.

If only three player stations are to be provided, then each need contain only two such player push buttons: a left push button analogous to left push button 40, and a right push button analogous to right push button 44. Furthermore, instead of designating the push buttons as left, center, right, etc., it would be possible to identify them with the number of the player station which each selects. Thus, with the four stations arranged in a circle and numbered clockwise as shown in 1, the left push button at station 4 would be identified as the "No. 1" pushbutton, the center pushbutton 42 would be identified as the "No. 2" pushbutton, and the right pushbutton 44 would be identified as the "No. 3" pushbutton. The use of station numbers is particularly convenient when the individual player stations are not located about a fixed circle, or if there are more than 4 player stations associated with the apparatus.

From FIG. 1, it may be clearly seen that player pushbutton switches 40, 42, and 44 are actually mounted on a horizontal platform 45 located in the interior of the associated player station, and are made accessable to the relevant player through an arch shaped opening 46. This has the advantage of allowing a player to conveniently operate his own set of pushbuttons without the other player being able to see which of the three buttons he has pushed, or when.

Figure 2:
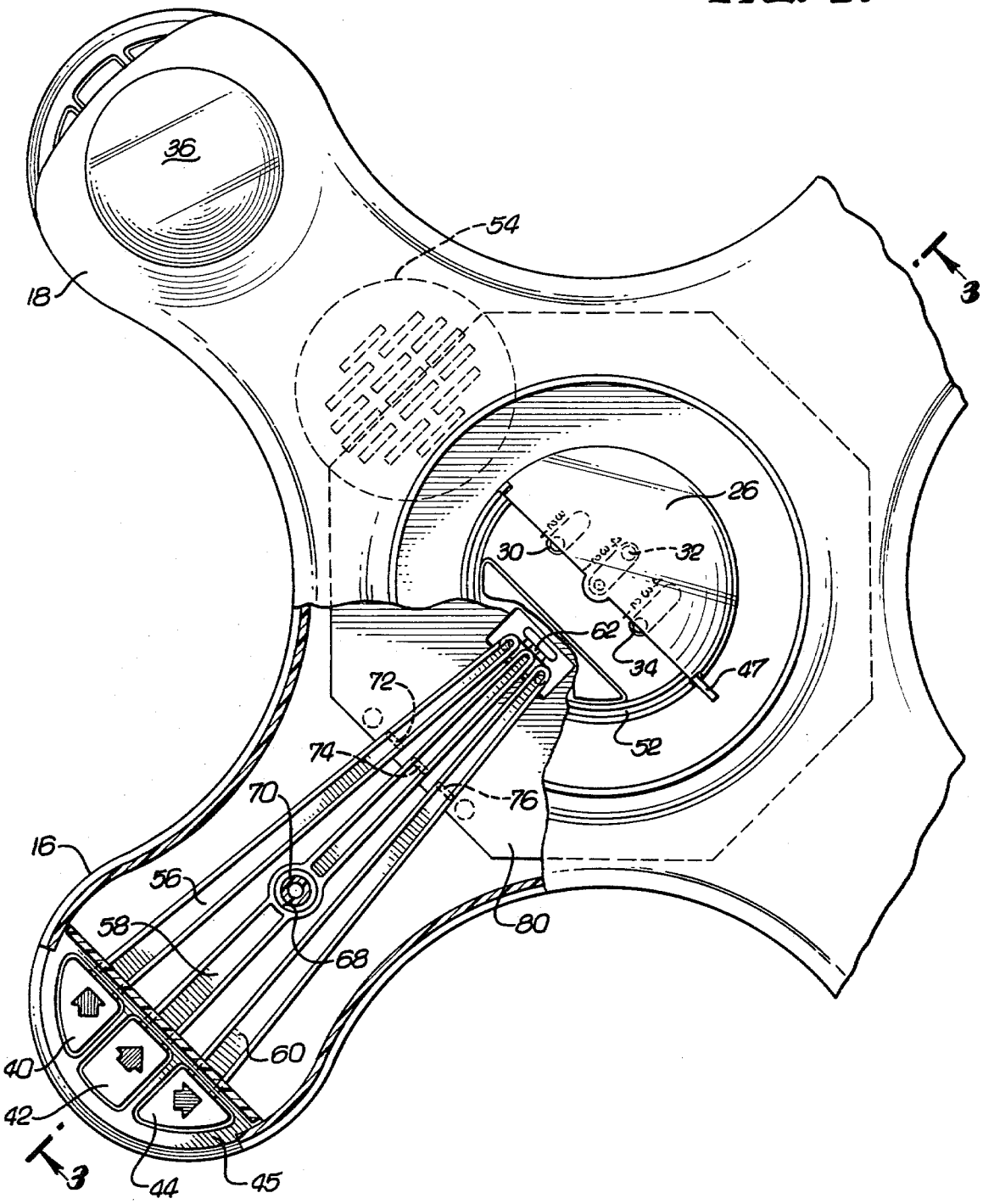
FIG. 2 is a bird's eye plan view of the apparatus of FIG. 1 in which a portion of the upper housing has been cut away to expose the manual station selecting mechanism therebelow.

Also visible in FIG. 1 is an ear 47 protruding radially outwardly from inner central dome hemisphere 24 (better visible in FIG. 2). Inner hemisphere 24 rotates with respect to outer hemisphere 26 about central pivot 48 (best seen in FIG. 3) and its lower edge 50 travels in circular track 52 provided in housing 12. An electrical contact (not visible in the Figures) is mounted to the underside of top housing 12 in the vicinity of circular track 52 such that when inner hemisphere 24 is in its closed position (and game start switch 28 and game control switches 30, 32, and 34 are concealed) the power is turned off, but when said inner hemisphere is in its fully opened position, (as depicted in the figures), then the power is turned on.

Referring now more specifically to FIG. 2, it may be seen that the underside of the apparatus is provided with a loudspeaker aperture 54 through which passes audible sounds produced by a loudspeaker (or other audio transducer). Also in FIG. 2, it may be seen that the upper portion of player station 16 has been partially cut away exposing the entire mechanical apparatus comprising left push button 40, center push button 42 and right push button 44. It can be clearly seen that all three of said push buttons are integrally molded in one piece, with left pushbutton 40 being located at the outer end of left arm 56, center push button 42 being located at the outer end of a center arm 58, and right push button 44 being located at the outer end of right arm 60. Left, center and right arms 56, 58, an 60 all terminate at their inner end at a common mounting tab 62 (better visible in FIG. 3) which is inserted through a corresponding slot 64 provided in a centrally raised portion of housing lower portion 14. The switch arm assembly (comprising left center and right arms 56, 58 and 60 respectively) is located in position by means of a locating opening 68 provided in center arm 58 which surrounds a locating boss 70 integrally molded onto the upper portion housing 12 (see also FIG. 3). Each of said arms is provided with a switch operating protuberance depending downwardly therefrom (indicated respectively by the reference numeral 72, 74, and 76). A vertical wall 78 integrally molded in lower housing 14 serves as a mechanical limit to the downward motion of player push buttons 40, 42 and 44. When one of said buttons, (for instance center push button 42) is pressed downwardly toward the top of vertical wall 78, it can be seen that center switch operating protuberance 74 is also forced downward thereby closing an electrical contact of a simple snap action switch assembly (not visible) mounted on printed circuit board 80.

It should be appreciated that while other configurations of switch operating assemblies may be usable with the present invention, the configuration illustrated is particularly convenient to assemble, and permits a relatively small printed circuit board to be employed, without requiring any separate wiring harness for connecting the electric switches with the rest of the electrical circuits or the circuit board.

From FIG. 3, it can also be seen that start switch 28 and game control switches 30, 32 and 34 may also be directly mounted to the central region of circuit board 80, and that below said circuit board (in a battery housing area designated by the reference numeral 84) is provided a power source, here shown as a plurality of dry cell batteries 86. Six small dry cell batteries can be conveniently accomodated in battery housing area 84 and, when suitably wired together in series, provide an output of approximately 9 volts. This should be quite sufficient to operate the four miniature incandescent light bulbs 38 and the various solid state electronic circuits.

Although the Figures show housing 10 as a single unit having four player stations 16, 18, 20 and 22 (each with their own miniature incandescent bulb 38 and player push buttons 40, 42, and 44) integral with and surrounding a central dome containing game start switch 28 and game control switches 30, 32, and 34, it should be appreciated that the individual player control stations need not be integrally moulded with one another and with the central control switches.

As one possible alternative, it should be possible to provide a single master station containing the various components associated with a single player station (such as a set of player push button switches 40, 42, and 44 and a miniature incandescent bulb 38), a suitable power source (and any required on/off switch), a set of game start and control switches (analogous to game start switch 28, game type switch 30, number of player switch 32, and skill level switch 34), all required electronic circuitry (mounted on a suitable printed circuit board analogous to circuit board 80), and a sound transducer (if sound effects are desired). Suitable electric cables may then permanently (or detachably) connect such a master unit with individual player slave units, each equipped with only a set of player push button switches 40, 42, 44 and an incandescent bulb 38. Such an alternate embodiment has the advantage of permitting one or more additional player stations to be purchased at a later time, thereby reducing the initial cost of the game apparatus to the consumer, while still preserving the capability of accomodating more than 2 or 3 players at a time.

As a second possible alternative embodiment, it should be possible to provide individual player stations, otherwise similar to station 16, 18, 20 and 22; however, each station could have its own power supply and could be provided with a radio receiver/transmitter for communicating—using conventional radio control technology—with a base unit similarly equipped with the required receiver and transmitter for radio communication with the individual player stations and having the required game controls and microprocessor electronics.

As has been mentioned previously, skill level switch 34 controls the percentage of time in the flashing cycle that the light is turned on as compared to turned off. At the easiest skill level (Skill 1), the light is on 66% of the time and off 33% of the time (a ratio of 4:2); in the case of the second, lower intermediate skill level, the light is on 50% of the time, and off 50% of the time (ratio of 6:6); in the case of the third skill level (high intermediate), the light is on 33% of the time and off 66% of the time (ratio 2:4); in the case of skill 4 (the hardest), the light is on 16% of the time and off 84% of the time (ratio of 1:6). Such a function may be implemented strictly with hardware components or alternatively by means of appropriate software techniques in conjunction with a microcomputer or microprocessor operating under the control of a stored program.

Furthermore, to add to the game's excitement, each various skill level may have its own distinctive short musical phrase and rhythmic pattern beat that is synchronized with each bouncing or flashing of the lights.

To further give interest to the game and to make it increasingly difficult as a round or volley proceeds, the tempo of the bouncing accelerates, always maintaining the ratio of on to off as determined by the set skill level. This acceleration continues until a plateau is reached which is determined by the processing speed of the circuitry and/or by the bulb filament's ability to display a distinct visible cut-off between rapid on and off cycles.

GAME DESCRIPTIONS

Before proceeding further with the description of the electronic circuitry, the various types of games that may be played utilizing the apparatus shown in the figures will now be described from the players' point of view, commencing with Game No. 1, "Pass to Anyone" which may be played by one, two, three, or four players.

After the power has been turned on, and an optional welcoming routine of sound and light effects has been completed, the particular game is selected (as well as number of players and the skill level) utilizing game control slide positionable switches 30, 32, and 34.

In the game "Pass to Anyone" (Game No. 1), each player must make the required pass in a timely fashion and the station selected to receive the pass must be a participating station for the pass to be good. In the event that there are only two players, they control respectively stations 1 and 3 and stations 2 and 4 do no participate for the course of the game. In the event that there are three players, station 4 does not participate. If there is only one player, the game is between stations 1 and 3; station 3, being under automatic control, always passes the light back to the player's station 1. Making ten successful passes in a row, not counting the initial pass, constitutes a win, once all the other players have been eliminated.

Assuming that Game No. 1 has been selected, and that four players have been designated by means of game control switches 30, 32, and 34, the game is initiated by the depressing game start switch 28 and the lights at the corresponding player stations participating in the game may then be flashed on and off to the accompaniment of a game theme song. The light commences bouncing at Station No. 1 until the player passes it to one of the other stations in the game. Depending upon how many flashes ("bounces") the light makes at station 1 before it was passed on, the player that receives the pass has the same number of flashes or bounces in which to pass the ball on. The tempo of the bouncing accelerates or speeds up within each round of game from an initial slow tempo to a maximum fast tempo. Each time a player is eliminated (a fact signified by the flashing of the loser's light accompanied by a "razz" sound), a new round is commenced with one less player and one less participating player station, until finally there is only one player left, who then attempts to make ten successful passes in the solo mode. If he does not succeed, he also gets the "razz" and his actual score is flashed by his light.

Game No. 2 is "Pass Around the Circle." It also may be played by up to four players and is similar in some respects to Game No. 1. However, within a round of the game the pass must always be in a predetermined direction (clockwise or counterclockwise) and after the first pass, the pass must always be on the first bounce in order to be good. Furthermore, the player stations that do not have a player assigned (or at which the player has been disqualified in a previous round) continue to pass the ball automatically, under computer control.

Assuming Game No. 2 has been selected by means of game type switch 32, the game is actually commenced by means of game start switch 28. A theme song individual to the particular game type may first be played. A light signal then slowly bounces (i.e. flashes on and off) to the optional accompaniment of suitable audible effects. At the same time, the light "moves" from station to station in either a clockwise (i.e. 1, 2, 3, 4) or counterclockwise (i.e. 1, 4, 3, 2) direction two times. The "bouncing" light then stops at station 1 and continues to bounce at a constant rate. The player at station 1 must "pass" the light by pressing his appropriate pushbutton (the left button in the case of an initial clockwise motion of the light, the right pushbutton in the case of initial counterclockwise rotation of the light). The player must start to press his button while the light is actually flashed on and prior to its flashing off. The next player in sequence after a successful pass must in turn pass the light to the next player. Once the light has been passed by the first player, the tempo at which it flashes on and off (and thus the speed at which it goes around the circle) speeds up until one of the players makes a mistake (i.e., not pressing the appropriate pushbutton at his station while his station's light is still lit). When such a player mistake is made, the player making the mistake is eliminated, his station light flickers and a "razz" sound is heard for 2–3 seconds. For the remaining rounds of the game, the light automatically is passed on the first bounce from the eliminated station to the next station.

Assuming that initially there is more than one player in the game, each successive round eliminates a player until only a single player is left. That player is the winner and his own station light signifies the fact by flashing to the accompaniment of a winner's tune. However, he still must play one solo round (the same as if the game were played by only a single player). The light starts its initial bouncing at his station and he attempts to pass the light from his station to the next in sequence 10 times (not including the initial starting pass), all the time the tempo accelerating. If he does not pass the light the required 10 times, the "razz" sound is heard and his score (the number of successful passes) is flashed by the lights to the accompaniment of suitable sound effects.

Game No. 3 is "Table Tennis" and may be played by 1, 2, 3, or 4 players. For this game, the four stations are divided into a first team comprising stations 1 and 2 which are regarded as being on one side of the net, and a second team comprising stations 3 and 4 and regarded as being on the other side of the net. The Number of Players switch 32, if set for one player, causes an automatic game to be played with the player operating the controls at stations 1 and 2, and the apparatus itself automatically controlling the operations of stations 3 and 4. There is no actual difference in the function of the game apparatus between 2, 3 and 4 players, since one or two players may operate the two sets of switches contained respectively at stations 1 and 2, and one or two other players may operate the two sets of switches contained respectively at stations 3 and 4.

Once the game has been selected, the number of players designated and the skill level preset, the game is commenced by pressing the game start switch 28. Thereupon, the lights at Team 1 (stations 1 and 2) flash together, alternating in tandem with the flashing of the lights at Team 2 (stations 3 and 4). A theme song particular to this game accompanies the flashing of the lights. Once the theme song has been completed, a single light starts "bouncing" at one of the stations and continues to "bounce" until it is served (passed) to one of the two stations at the other side of the net. When it is thus served, it must immediately be passed back across the net (i.e., on the first bounce). As in the case of the other games, the tempo of the bouncing speeds up automatically during each rally. When one of the players fails to effect a timely pass to the other side of the net, the "razz" sound is heard and the light starts to bounce anew, awaiting the serve. After one side has served five consecutive times, the other side is given the serve. Depending upon the skill level set, the winner is the side scoring 7, 11, 15, or 21 points unless there has been a shut-out, with one side scoring the first 7 points. The winners are announced by the lights flashing in tandem according to how many points more than the loser's was scored by the winning side (never less than 2).

In the case of the solo play, the single player operates the center and right buttons of Stations 1 with his right hand, and the center and left buttons of Station 2 with his left hand. The operation of Stations 3 and 4 is automatically controlled by the apparatus. The player has the first five serves, and wins a particular volley if he successfully hits the ball 10 times, not counting the initial serve.

The bouncing (i.e. flashing) of the lights simulating the ball may be accompanied by audible "pings" and "pongs".

THE ELECTRICAL COMPONENTS

Figure 4:
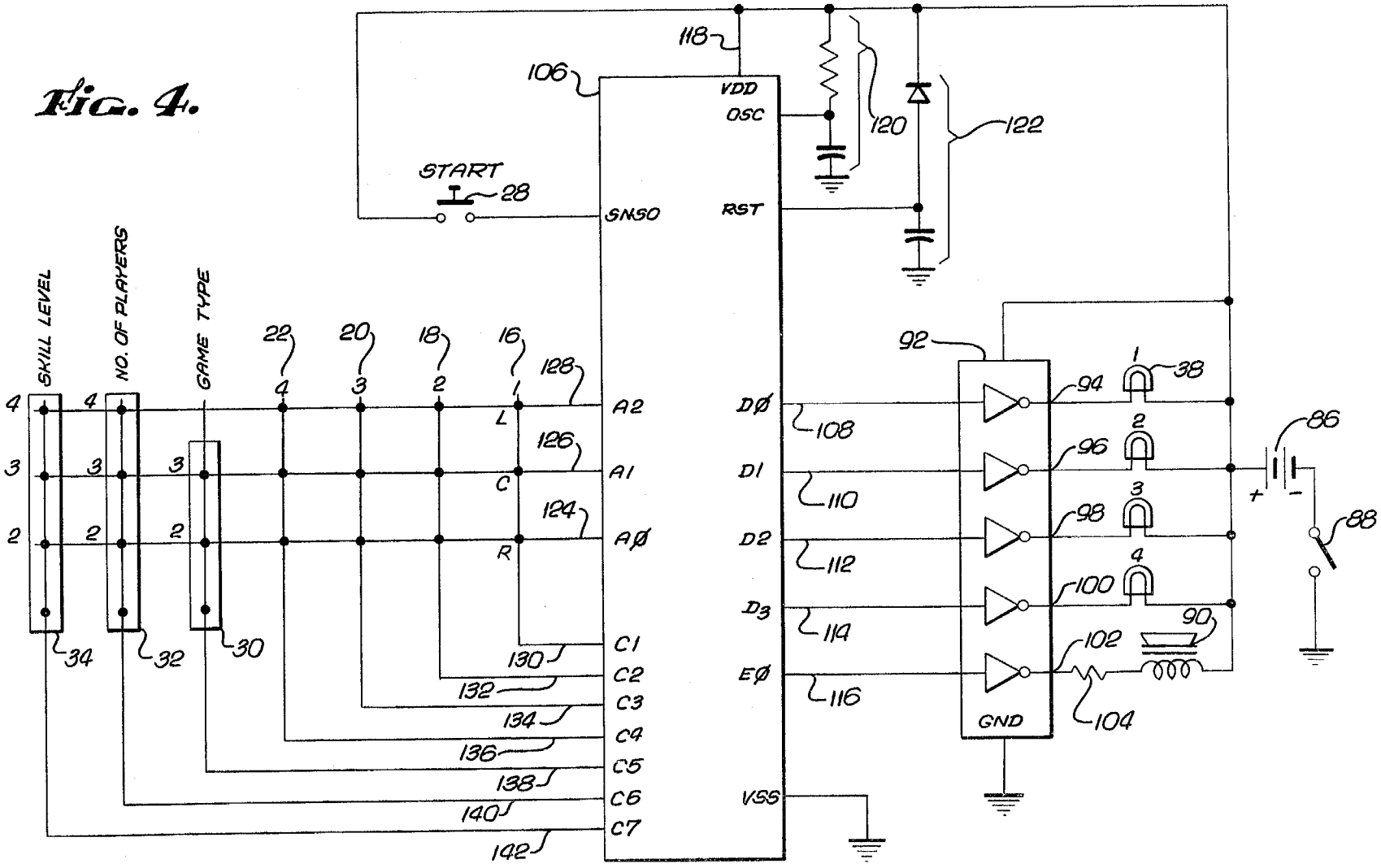
FIG. 4 is a circuit diagram of the electrical and electronic components of the apparatus of FIG. 1.

Referring now to FIG. 4, which is an electrical circuit diagram showing how the various electrical and electronic components are connected to one another, it may be seen that power supply 86 (which is of a nominal 9 volts) is applied via a power switch 88 to (1) the plus terminal of speaker 90, (2) the four incandescent light bulbs 38 identified respectively with stations 1, 2, 3 and 4; and (3) a five channel current driver/amplifier 92 (which may, for instance, be of the type commercially available under part type no. 75491; however, any similar inverting or noninverting amplifier/driver will suffice). The five channels of output from said driver/amplifier are designated respectively with the reference numerals 94, 96, 98, 100 and 102. First output channel 94 leads to the incandescent bulb 38 at station 1, second channel 96 controls the light bulb at station 2, third channel 98 controls the lamp at station 3, fourth channel 100 controls the lamp at station 3, and fifth channel 102 is connected to the speaker (or other sound transducer) 90 via a volume level limiting resistor 104. The respective five channels of input to amplifier/driver 92 are from the outputs of microprocessor 106 labelled respectively D0 (for first microprocessor output channel 108), D1 (for second channel 110), D2 (for third channel 112), D3 (for fourth channel 114), and E0 (for fifth channel 116). Power from power source 86 is input to microprocessor 106 via switch 88 and power input 118 labeled "VDD". The inputs labeled "OSC" and "$\overline{RST}$" are also connected to the positive side of power supply 86 via a resistor/capacitor/bridge 120 (in the case of the input OSC) and a diode/capacitor bridge 122 (in the case of input $\overline{RST}$). These connections determine respectively the internal clock rate of microprocessor (OSC) and the amount of delay between the closing of switch 88 and the start of processing. A momentary application of power via start switch 28 to start terminal SNSO causes control of microprocessor 106 to be transferred to the start of its initialization routine in which type of game is selected, etc.

Also provided as input terminals to microprocessor 106 are three switch matrix row terminals designated respectively (1) A0 to which is connected second row 124 comprising the right pushbuttons 44 of first, second, third and fourth player stations 16, 18, 20, and 22 respectively, as well as the two position of game select switch 30, the two player position of player number select switch 32, and the two position of skill switch 34; (2) A1 to which is connected the third row 126 of said switching matrix comprising the center pushbuttons 42 of the four player stations and the number three positions of the three game control switches; and (3) A2 to which is connected the fourth row of said switching matrix comprising the left pushbuttons of the four positions of the number of player switch 32 and skill level switch 34.

Microprocessor 106 is provided with seven multiplexed scan outputs connected respectively to the seven columns of the switching matrix: First switch matrix column 130 is connected to the microprocessor's "C1" scan output, second column 132 to scan output "C2", third column 134 to "C3", fourth column 136 to "C4", fifth column 138 to "C5", sixth column to "C6" and seventh column 142 to "C7". First column 130 is in turn connected to the three player-operated pushbuttons at first player station 16; second column 132 is connected to the three pushbuttons at second player control station 18; third column 134 is connected to the three pushbuttons located at the third player control station 20; while fourth column 136 is connected to three player buttons at player station number four. The fifth column input line 138 is associated with game type switch 30, the sixth column 140 is associated with the number of players switch 32, and the seventh column 142 is associated with skill level switch 34.

It will be noted that there is no connection between the first positions of skill switch 34, of number of players switch 32, or of game type switch 30 and the microprocessor 106. These first positions are so-called default positions, and unless the microprocessor detects (for instance) a connection between one of the three input rows 124, 126 and 128 and skill switch column 142, it may be assumed that skill switch 24 is in number one position. Similar comments hold for number of players switch 32 and for game type switch 30.

Since skill switch 34, number of players switch 32, and game type switch 30 are all preferably slideably positionable switches that presumably have no contact overlap, the setting of these three switches will have no effect on the microprocessor's ability to determine when one of the player pushbuttons at one of the player control stations has just been depressed or released during the course of a game.

Although a commercially available microprocessor sold by Panasonic under the designation MN 1400 is believed to be particularly suitable for employment as microprocessor 106, it should be understood that there are many other types and configurations of microprocessors or microcomputers which could also be selected as the microprocessor utilized in the described preferred embodiment. Furthermore, although in the case of game apparatus that is intended to be mass produced and mass marketed, it is preferable to employ a microprocessor whose program memory has been preprogrammed during the course of manufacture by use of an appropriate custom mask, it would also be possible to utilize semiconductor program memories whose contents are loaded from an external program storage medium. Furthermore, it should be well within the capabilities of a person skilled in the art to adapt the described preferred embodiment for use with slower, less powerful processors than the aforementioned Panasonic MN 1400, or even for use with two separate microcomputers connected to one another in a master/slave arrangement.

THE ASSOCIATED SOFTWARE

An exemplary set of software routines which may be loaded into the program memory associated with microprocessor 106 of FIG. 4 are shown in functional block diagram form in FIGS. 5 through 13. Throughout these flow charts and related diagrams, reference will be made to the variable "D" to indicate which is the then active player station and accordingly which of the outputs from output lines D0, D1, D2, or D3 will be turning on and off to indicate that its associated station is "active". For example, if the variable D equals 0, then from FIG. 4 it can be seen that the corresponding player station is Station no. 1 (reference numeral 16).

It will be recalled that the player at an active station designates one of the other stations by depressing a left, center or right pushbutton (reference numerals 40, 42, 44) at his own station, and that a corresponding signal is input to microprocessor 106. When for instance, the player at Station no. 1 designates the station directly across from him (i.e. Station no. 3, or D=2), then microprocessor input row A1 is connected to scan output column C1.

Figures 5, 6:
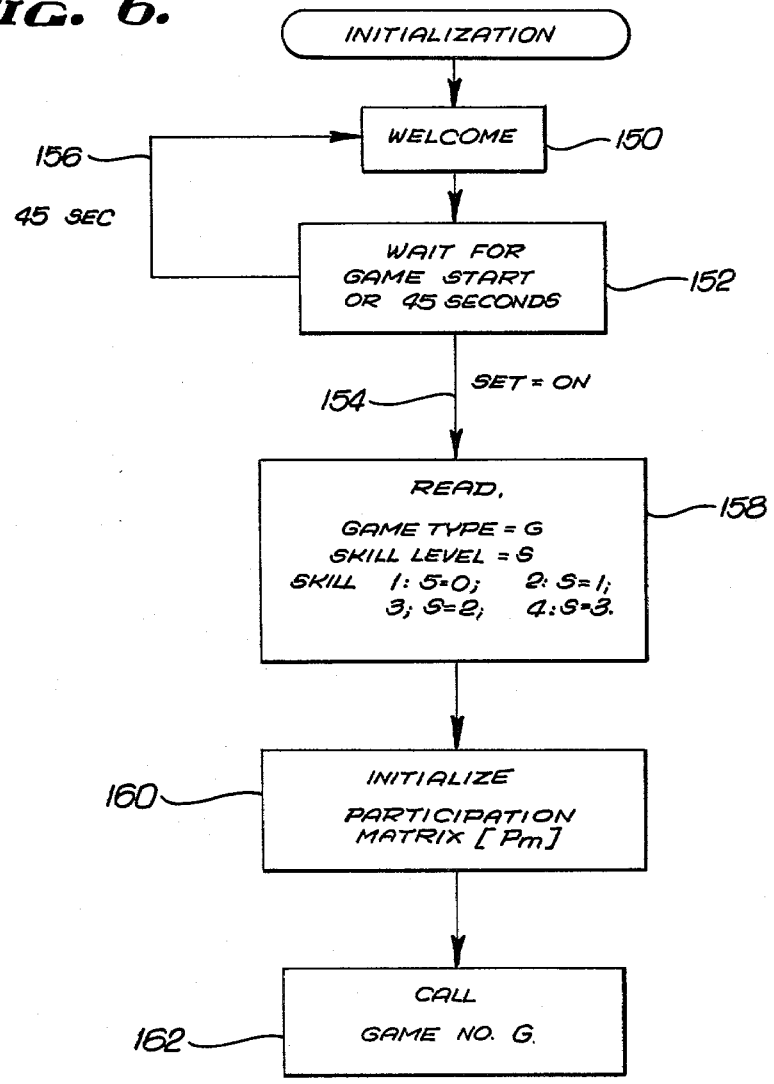
FIG. 5 is a matrix table showing the values of $F_n$ according to which button was pushed at which player station.
FIG. 6 is a flow chart of the INITIALIZATION Program common to all three games.

In order for each new value of variable D to be computed (designated symbolically on the flow charts as "$F_n$" "(D, input)"), the function is represented in matrix form within the body of the stored program in the manner shown at FIG. 5. To the left of FIG. 5 are the labels A0, A1, and A2 corresponding to the three input rows. At the upper portion of the figure are the designations C1, C2, C3 and C4 corresponding to the first four input columns associated with the four respective Player Stations. Within the body of the table are the values of the variable D for each intersection of a row input with a column input.

Thus, in the aforementioned example (Station 1 designating Station 3 by closing the connection between row A1 and column C1), from the matrix table of FIG. 5 it may be seen that the resultant value of variable D is D=2 (i.e. Player Station no. 3).

Also in the flow charts it should be noted that the usual flow charting conventions have been employed, and that for the most part program flow is from the top to the bottom of the Figure and from its left to its right. Exceptions to this general rule are always indicated by arrowheads in the direction of flow from one block to another. When a particular block involves a decision making operation, there will normally be at least two output branches from that block, each labeled with a brief reference to the decision outcome associated with that particular branch.

A horizontal dotted line connecting two functional operations indicates that those operations are being performed more or less simultaneously, for instance, by means of a loop in one block which repeatedly calls the other block as a subroutine within the loop.

Figure 7A:
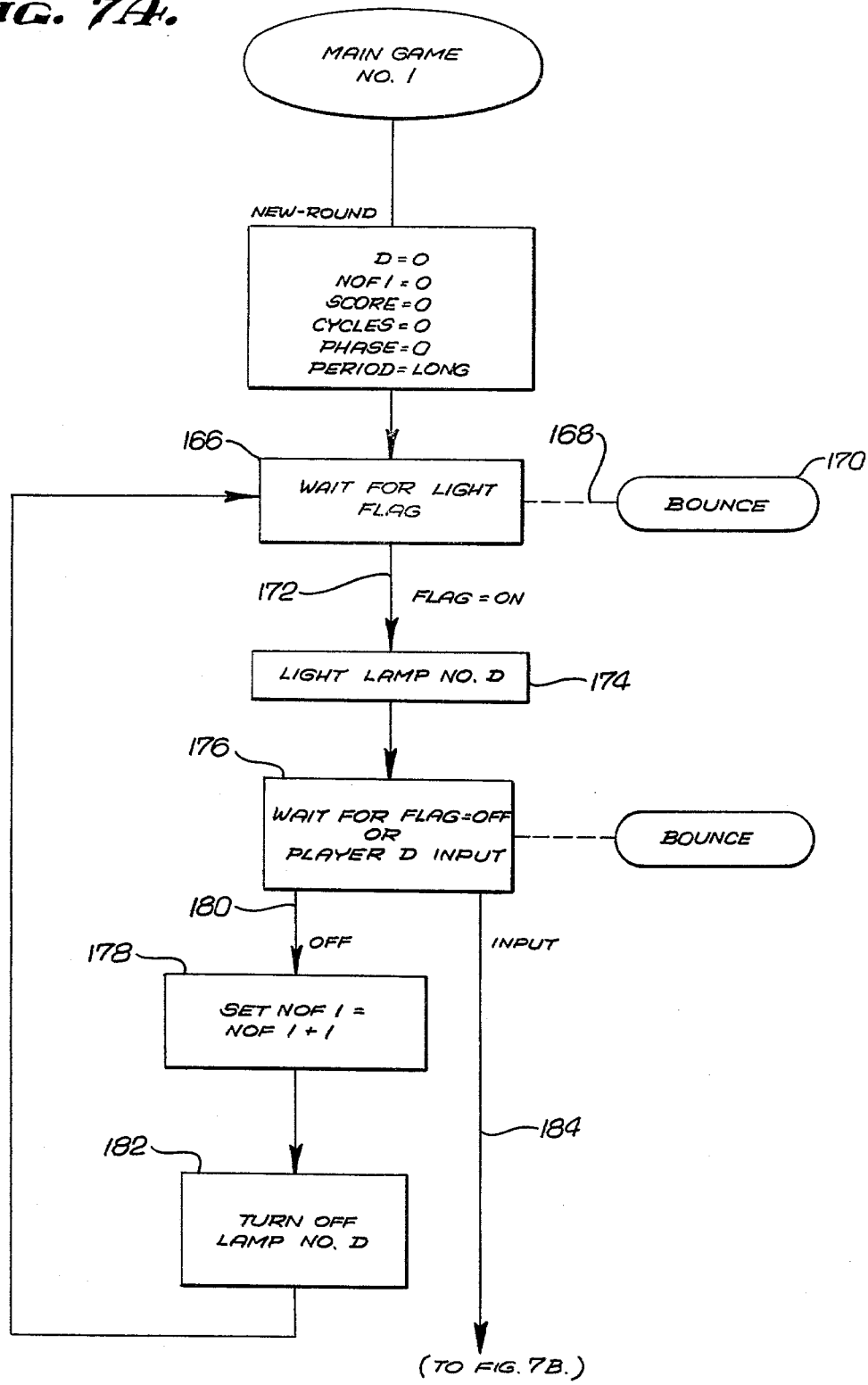
FIG. 7 (comprising a first portion FIG. 7*a* and a second portion FIG. 7*b*) is a flow chart showing the MAIN Program for Game No. 1, with control flowing from FIG. 7*a* to FIG. 7*b* as indicated.

The computer program associated with Game no. 1 (Pass to Any Player) will now be discussed in detail, with particular reference to FIG. 6 (showing the INITIALIZATION routine common to all three games), FIG. 7 (comprising FIGS. *7a* and *7b*, and showing the MAIN program for "Game No. 1"), FIG. 8 (showing the BOUNCE routine that is constantly interacting with the Game No. 1 MAIN program, and which is also used by the main programs for the other games), FIG. 9 (which shows the RAZZ subroutine which is called by the Game No. 1 MAIN program and also the main programs fro the other games), and FIG. 10 (which shows the "Wait Loop" of FIG. 7 in more detail).

Referring now specifically to FIG. 6, showing the game start or INITIALIZATION program, the first function performed by this program is the Welcome routine indicated symbolically by box 150. This welcoming routine causes the various lights 38 to be flashed on and off to the accompaniment of suitable audible sound effects through loudspeaker 90 for approximately two seconds, whereupon control is transferred to the second functional block, namely the Wait For Game Start block 152. The processor then continues to wait for up to 45 seconds to see whether or not the game start control button 28 is depressed indicating that the various game control switches 30, 32, and 34 have been set and the players are ready to start playing. If this is so, indicated diagramatically by the branch from block 152 labelled "Set=On ", said branch bearing the reference numeral 154, control passes to block 158 discussed in more detail hereinafter. Second branch 156 is labelled "45 Seconds" and indicates diagramatically that upon the expiration of the aforementioned 45 second waiting period without game start button 28 having been depressed, control is returned to the Welcome routine 150 and the above described flashing of lights and the accompanying sound effects is again repeated.

In accordance with said block 158, once game start switch 28 has been depressed, game type switch 30 and game skill level switch 34 are read. The variable G is set in accordance with game type switch 30 to indicate the type of game: Game 1 being indicated by a 1, Game 2 being indicated by a 2 and Game 3 being indicated by a 3. The position of skill level switch 34 determines the value of the variable S: Skill Level 1 results in S=0, Skill Level 2 results in S=1, etc. Control is thereupon passed to block 160 in which the so-called Participation Matrix (symbolized by "$[P_m]$") is initialized, based on the setting of the number of players switch 32. This participation matrix is actually but a single row four columns wide, with each column representing a respective player station. If number of players switch 32 has been set to 1 then the value of $[P_m]$ is [(1,0,0,0)]. For two players, it is [(1,0,1,0)]. For three players, [(1,1,1,0)] and for four players it it [(1,1,1,1)]. It will be recalled that in the case of a game involving only two players the two players are normally seated across from one another at Player Stations 1 and 3 respectively. In the case of the solo mode of operation (only one player), the single player is seated at Player Station No. 1 (although at least in Game No. 3, he also has access to the player controls at Player Station no. 2).

The participation matrix having been initialized by block 160, the particular game program as determined by the value of G is then called. FIG. 7 (comprising FIGS. *7a* and *7b* with control passing from the blocks in FIG. *7a* to the blocks in FIG. *7b* as shown), shows the MAIN routine for Game No. 1 and will now be discussed in detail.

Referring first to the portion of the Game No. 1 MAIN routing shown in FIG. *7a*, it may be seen that the first function performed is the setting of the variables "NOF1", "SCORE", "PHASE", "CYCLES", "PERIOD", and "D" in the block designated with the reference numberal 164 and labeled "NEW-ROUND".

Variable NOF1 keeps track of the number of "bounces" of the light that occured at the previous Player Station prior to the passing the ball. SCORE is particularly meaningful only during the final or solo round of play and is then used to determine whether or not the player has returned 10 passes successfully. PHASE, PERIOD, and CYCLES are variables used by the BOUNCE subroutine to keep track of respectively at which of 12 intervals the subroutine is within a single "bounce" cycle, the predetermined time between successive "bounces", and the elapsed time since the start of the current interval phases period. PHASE and CYCLES are initially set to "0"; PERIOD is initially set to a predetermined VALUE; the precise range of PERIOD'S values is determined at least in part by the acutal speed of the microprocessor and by the incandescant light bulb filament's ability to display a distinct cut-off between on and off at a high rate of flashing.

The various program variables having thus been preset in block 164, the program now proceeds to wait for a global flag known as the Light Flag to be turned "On" by the BOUNCE routine. This waiting function is indicated diagramatically in block 166, which it may be seen is synchronized (shown diagramatically by dotted double arrowhead line 168) with said BOUNCE routine 170 (described hereinafter in more detail with particular reference to FIG. 8).

When control is in the "Wait Loop", as indicated in block 166, the microprocessor continually (a) samples the condition of said Light Flag, (b) call the BOUNCE subroutine, (c) decrements counters used to determine when the $E_0$ output 116 of the microprocessor (which will be remembered, is connected to a loudspeaker 90 by an amplifier/driver fifth channel 102) should next be "toggled" (turned on if already off, turned off if already on), thereby generating a specific musical tone and rhythm pattern as predetermined in a RHYTHM table stored in the microprocessor, and (d) scans the switch inputs from the left, center and right switches at each of the four player stations. Thus it may be seen that most of the time microprocessor 106 is in a "loop" performing cyclic "housekeeping" operations while waiting until it is time to turn the light on or off or until an input signal is received from one of the player stations.

When the Light Flag has finally been set "on" by the BOUNCE routine as indicated by the label "Flag=On" associated with flow line 172, control is now passed to block 174, wherein the lamp associated with the then current value of the variable D is lit. It will be recalled that in block 164, variable D has been set to 0; since no intervening block has caused the value of D to change, it is always the D0 lamp at Station No. 1 that is caused to be lit by block 174.

From block 174, control then passes back to the "wait" loop as indicated symbolically by block 176. However, this time the microprocessor is checking both the condition of the Light Flag maintained by the BOUNCE routine, and of the various Player Station input lines. As was the case with the wait loop of block 166, the BOUNCE subroutine is called at regular intervals.

Although the BOUNCE routine will be described hereinafter in greater detail in connection with FIG. 8, at this point it may be mentioned that the BOUNCE routine is responsible for determining when the various lights associated with output lines D0, D1, D2, and D3 are turned on and off, and hence when activation of the player input pushbutton switches is "timely" or "untimely" and when a particular Station becomes "active" or "inactive".

Assuming that the Light Flag has been turned off by the BOUNCE routine prior to any input being received from Player D (it will be recalled that at this point in the program D equals 0) then control is passed to box 178 via off branch 180 and the program variable NOF1 is incremented by 1 indicating one light cycle or bounce prior to any reaction by the player at the station. Control then immediately passes to box 182 wherein the lamp is turned off and control is returned to the wait loop as indicated in block 166.

Figure 7B:
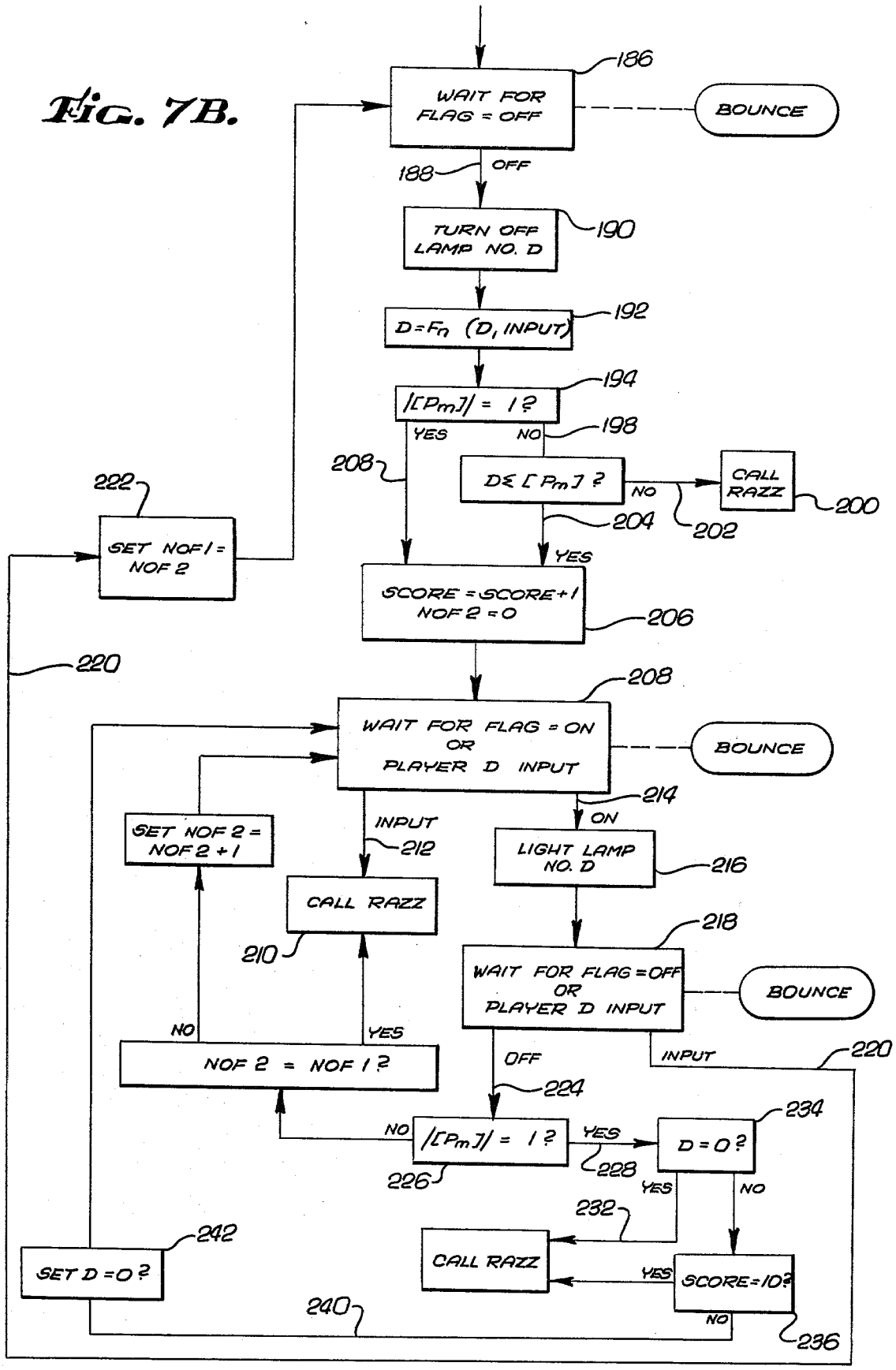
Figure 8:
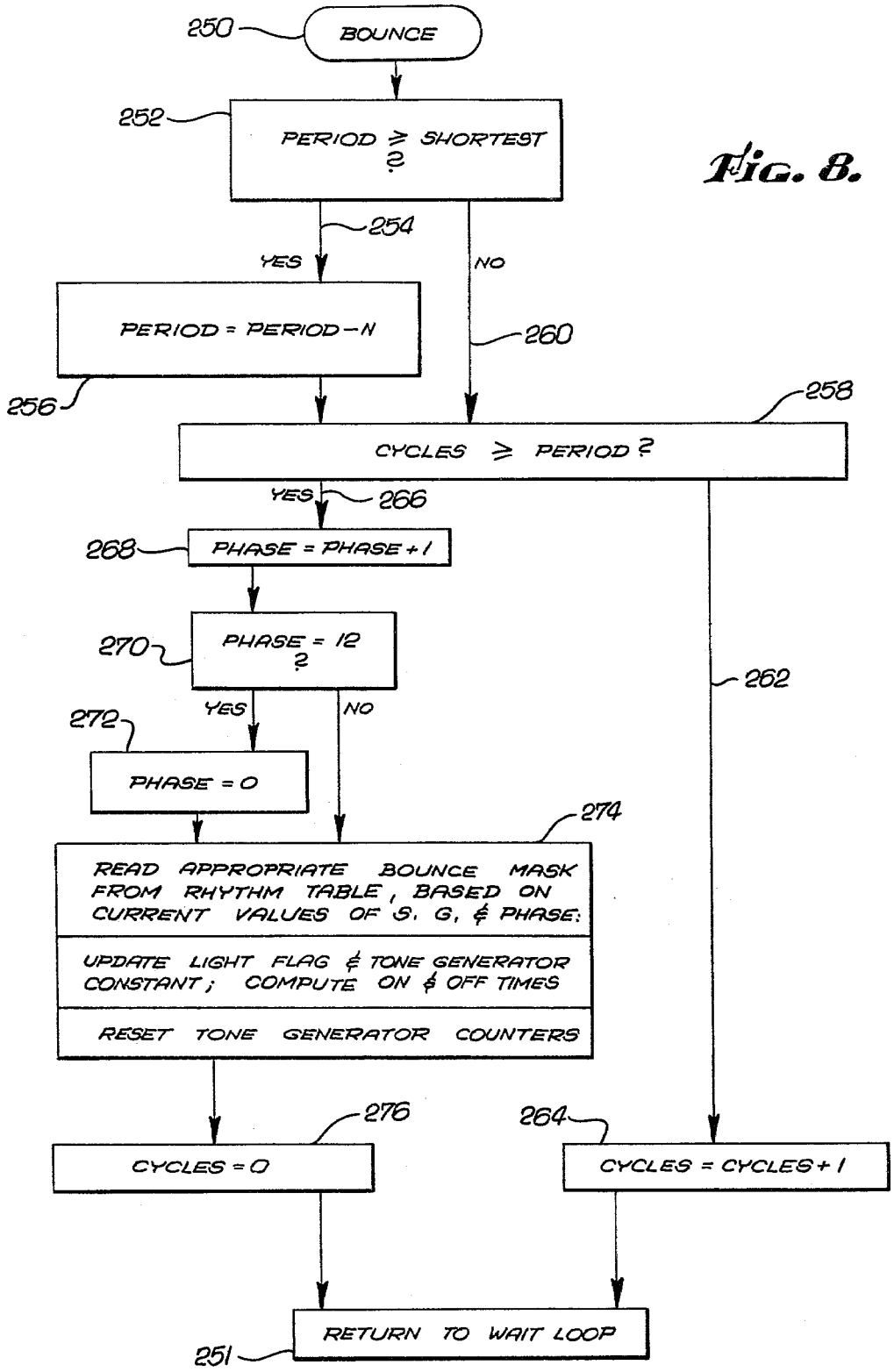
FIG. 8 is a flow chart illustrating the BOUNCE subroutine utilized in all three games.

The program will continue to cycle through the [wait, turn on the light, wait, turn off the light, increment the NOF1 counter] loop, until finally the player at Station No. 1 (D=0) presses one of the three pushbuttons at his station while the Light Flag is turned "On" and prior to its being turned "Off", as signified by the flow line labeled "Input" and bearing reference numeral 184, which causes control to be transferred to the portion of Game no. 1 program illustrated in FIG. 7*b*.

Referring now specifically to said FIG. 7*b*, it may be seen that a timely (i.e., the Light Flag is on) initial input by the player at Station No. 1 causes control to be transferred to block 186 and the program again enters the Wait loop waiting for the Light Flag to be turned "Off". Since the player at the first station has made a "timely" selection, the light at his station is still on, and it is not necessary to check at this stage of the program for any additional player inputs and accordingly they may be ignored. Once the Light Flag has been turned "Off" as indicated by the branch from block 186 labeled "Off" bearing reference numeral 188, control now passes to block 190 and the lamp that was then on is turned off. The new value of D is then computed by block 192. As mentioned previously in connection with FIG. No. 5, this computation is actually conveniently implemented in the form of a table look-up type of operation.

Control then passes to block 194 which determines whether the game is in a one player (solo) mode or, as indicated symbolically, whether the absolute value of the Participation Matrix is equal to 1, that is to say that all entries of the matrix are set to 0 except for a single 1. If the game is not in the solo mode, then control passes to block 196 via the branch designated 198 and labeled "No". Block 196 tests whether or not the current active station (symbolized by the variable D) is one of those stations identified as participating in the participation matrix $[P_m]$. If not, that is to say if the player at the active station has attempted to pass the light to a station at which there is no player, or a disqualified player, then that is a mistake and the RAZZ routine (block 200) is called via "No" branch 202. If the selected station is a participating station, as indicated by "Yes" branch 204 then control transfers to block 206 wherein the variable "SCORE" is incremented and "NOF2" is set to 0. NOF2 is a program variable used to keep track of the number of bounces at the current station until a successful pass has been made or the permitted number exceeded.

If the game is in the solo mode and there is only one station set as "participating" in the Participation Matrix, then control is transferred directly from block 194 to block 206 via "Yes" branch 208, since it is obviously unnecessary in the event to determine whether or not the selected station is a participating station. It will be recalled that in the solo mode for Game No. 1, the single player may select any one of the three other stations and the computer then automatically returns the ball to him on the first bounce regardless of which station he has selected.

The variables SCORE and NOF2 having been updated in block 206, control then passes to the Wait loop of block 208. The microprocessor again constantly checks the condition of the Light Flag and for input signals from the player at current active station associated with the variable "D" while at the same time regularly calling the BOUNCE routine. In the event that the player at the active station presses one of his pushbuttons before his station's light has been turned on, indicating both that the station is active and that operation of one of the select pushbuttons would then be timely, the RAZZ routine is called by block 210 via branch 212. Alternatively, if the Light Flag is turned "On" by the BOUNCE routine prior to any input signal from the player at the D station, as signified by branch 214, then control passes to block 216 wherein the lamp at the D station is lit signifying that operation of one of its station select pushbuttons would now be timely, and program control passes to the wait loop of block 218 wherein the processor again continuously monitors the condition of the Light Flag, to determine if it has been turned "Off" by the BOUNCE routine and at the same time if there has occured a pushbutton input from the D player station. If an input is received from the D player prior to the Light Flag being turned "Off", then control passes via branch 220 labeled "Input" to block 222, wherein the variable NOF1 is reset to the value of variable NOF2 and control then returns to block 186. Eventually, if a participating station has been selected, the selected station then becomes the active station and the program repeats as aforesaid. Alternatively, if the Light Flag is turned "Off" by the BOUNCE routine prior to any input being detected from the D player during wait loop 218, control then passes via "Off" branch 224 to block 226 wherein the participation matrix is again tested to determine whether or not the game is in its solo mode. If the answer is yes, as indicated by branch 228 to block 230, a second test is made to determine whether or not the then active station is the station associated with output D0. A yes means that the solo player at Station no. 1 did not make a timely response while his station was still active and, accordingly, he has lost and the RAZZ routine is called by program branch 232 labeled "Yes". If the current active station is not the station associated with output line D0, as indicated by program branch 234, then the current active station is one of the stations controlled by the computer and a third test is made in block 236 to determine whether or not the current score equals 10. If the answer is yes, the solo player has won, and control is passed via branch 238 to the RAZZ routine. Otherwise control is passed via "No" branch 240 to block 242 and Player Station No. 1 (which it will be recalled is associated with output line D0) is automatically selected by the computer just when "On" changes to "Off" and control passes to block 208 which then again monitors the condition of the Light Flag and the inputs, if any, from the player at the station associated with output line D0.

The aforesaid description of the flow-chart associated with Game No. 1 made mention of a subroutine entitled "BOUNCE". This subroutine is shown diagramatically in flow chart form in FIG. 8. It is entered through the block labeled "BOUNCE" and bearing the reference numeral 250, and is exited through block 251 which returns control to the wait loop which originally called the subroutine. After control has entered the subroutine via block 250, a test is made in block 252 to determine whether or not the program variable PERIOD is already at its lowest value. It will be recalled that a specific value associated with the constant represented symbolically by the label "SHORTEST" is determined by the speed of processor 106 and by the physical and electrical properties of the incandescent bulbs 38. If the PERIOD established by the BOUNCE routine is not already at its lowest as indicated by branch 254 labeled "Yes," then PERIOD is decremented by N in block 256.

"N" is a constant determined experimently such that the tempo of the bouncing accelerates at a rate that is barely perceptable to the players from one bounce to the next, but which nevertheless is readily perceived as being faster after a dozen or so bounces than it was at the beginning of the round. If desired, "N" itself can be a variable dependent on the current value of PERIOD. Thus, if PERIOD has not yet been decremented to the midway point between LONG and SHORTEST, "N" could have the value "2," and the relatively long bounce periods at the beginning of the round could be decremented relatively quickly; on the other hand, if PERIOD is between its midpoint and its SHORTEST value, then N could take the value "1" and successive period would then be closer to one another in value.

In any event, in block 258, the BOUNCE subroutine compares the current value of the variable CYCLES (which, it will be recalled, keeps track of the elapsed time since the start of the current one of the twelve intervals within a full bounce cycle) with the current value of PERIOD.

If CYCLES is not greater than or equal to PERIOD, as represented in the flow chart "No" branch 262, the current count for CYCLES is increased by 1 in block 264 and control returns back to the Wait Loop as indicated by block 251. Alternatively if the CYCLES count presently equals or exceeds the limit set by the current value of PERIOD, as indicated by "Yes" branch 266, this indicates that the end of the current interval in a full bounce (light on/light off) cycle has been reached and it is time to enter a new interval within the cycle. Accordingly, the program variable PHASE is incremented by 1 in block 268, and since the Rhythm table treats each bounce cycle or "measure" as being divided into twelve intervals, PHASE is calculated modulo 12, and thus block 270 tests to see if PHASE is already 12, in which case it is reset to "0" in block 272. If PHASE is not yet already 12, control passes directly to block 274. In either event, block 274 reads the current Bounce Mask from the Rhythm matrix, accessing the proper mask with the matrix by skill level S, game type G and the current value of PHASE. The program uses the mask thus obtained to update the Light Flag and reinitialize the counters and Frequency constant used by the Tone Generator.

In that regard it should be mentioned that the aforesaid Bounce Mask has a first single bit field representing the setting of the Light Flag, a second multi-bit field indicating the constant value to which the Tone Generator Frequency counter is to be reset each time it counts down to zero and the audio channel output 116 toggled, a third multi-bit field indicating the timing factor to be applied to the current value of PERIOD before it is loaded into the TIME-OFF counter thereby determining the duration of the current tone (after which the Tone Generator remains silent until the beginning of the next interval, and, optionally, a fourth multi=bit field having a second timing factor that, when applied to the current value of PERIOD, establishes the initial value of an optional TIME-ON counter thereby permitting a delay or syncopation effect between the start of one of the twelve intervals and the musical tone associated therewith.

The Bounce Mask having thus been read in block 274 and the appropriate values of the Light Flag and the various constants required by the Tone Generator having been computed and/or stored and the tone counters frequency and duration counters reset, the variable CYCLES is reset to "0" in block 276 and control returns back to the Wait Loop as indicated by block 251.

One of the reasons for thus dividing a single bounce "Measure" into 12 more or less equal intervals, each associated with a different value of PHASE and a different Bounce Mask in the Rhythm Matrix, is to permit different rhythm patterns to be accommodated, such as a waltz (ONE, two, three), a march (ONE, two, THREE, four), or a six-eight ballad tempo (ONE and a, TWO and a), the integer 12 being the lowest common multiple of 3, 4, and 6. Furthermore the various skill levels may be conveniently represented by different combinations of settings of the Light Flag for each of the 12 intervals. Thus Skill Level 1 (S=0), which it will be remembered has the light on for two-thirds of the cycle and off for one-third of the cycle, may be conveniently represented by four successive intervals in which the Light Flag is set to 0 ("Off") followed by eight successive intervals in which said Light Flag is set to 1 ("On"). For Skill Level 2 (S=1), the required 50–50 ratio may be achieved by setting the Light Flag "Off" for the first six intervals and "On" for the second six intervals. In a similar manner for S=3, the Light Flag should be set with eight intervals in which the flag is "Off" followed by four intervals in which it is "On," and for S=4, ten intervals of "Off" followed by two intervals of "On." If syncopation effects are required for delaying the start of a tone relative to the lights, such may be achieved by means of the above described TIME-ON counter.

Figure 9:
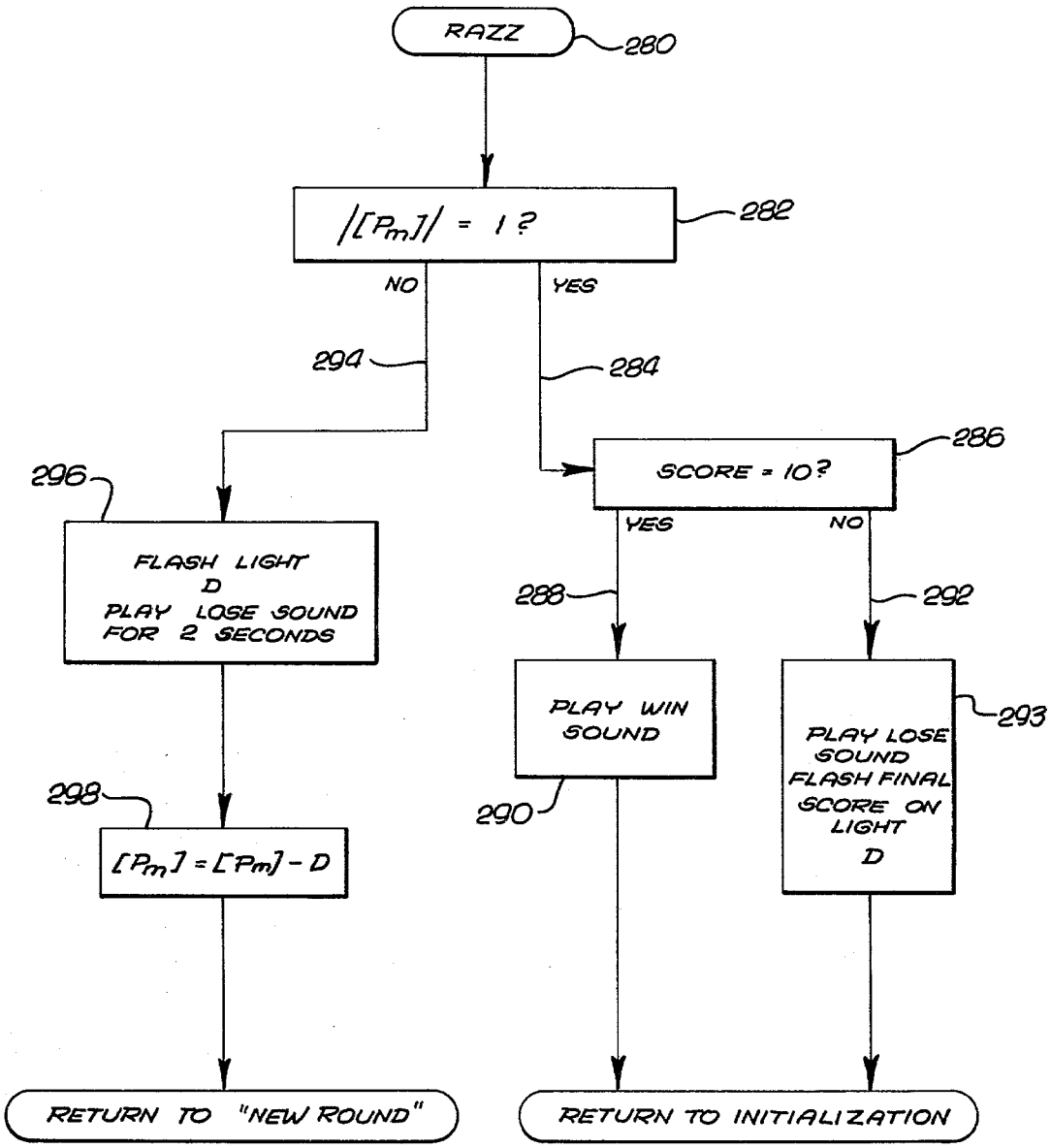
FIG. 9 is a flow diagram of the RAZZ subroutine utilized in the first two games.

The other subroutine called by the program for Game No. 1 is subroutine RAZZ and is shown in flow diagram form in FIG. 9. The RAZZ subroutine is entered through block 280 which immediately passes control to block 282 which checks to see whether the game is in the solo mode (with only a single "1" being contained in the participation matrix $[P_m]$), a condition indicated by "Yes" branch 284 which transfers control to block 286. Block 286 tests the variable SCORE to determine whether or not the score is already "10" and the game has now been won, in which case control passes via "Yes" branch 288 to block 290. Control block 290 causes a "Win" song to be played on loudspeaker 90, signifying that the game has been successfully won and control then again passes to the INITIALIZATION routine of FIG. 6, which again welcomes the players to the start of a new (and possibly different) game.

On the other hand, if, when the RAZZ subroutine has been called, the game is in its solo mode but the score has not yet reached 10 (a condition indicated by the "No" branch 292) the routine causes a lose sound to be heard over loudspeaker and the final score (as stored in variable SCORE) to be flashed on Light No. D. The losing sound may advantageously be a buzzing type of sound commonly known as a "raspberry"; hence the name of this subroutine.

If at the time the RAZZ subroutine is called, the game is not in its solo mode but rather there are at least two participants remaining in the participating matrix $[P_m]$, a condition indicated symbolically by "No" branch 294, then light D is flashed to indicate that the player at the associated station has been disqualified and the losing sound is heard, as shown symbolically in block 296. The RAZZ subroutine then eliminates the losing station from the participation matrix, as shown schematically in block 298, and control is returned to the entry point "NEW-ROUND" at the start of the game program.

Figure 10:
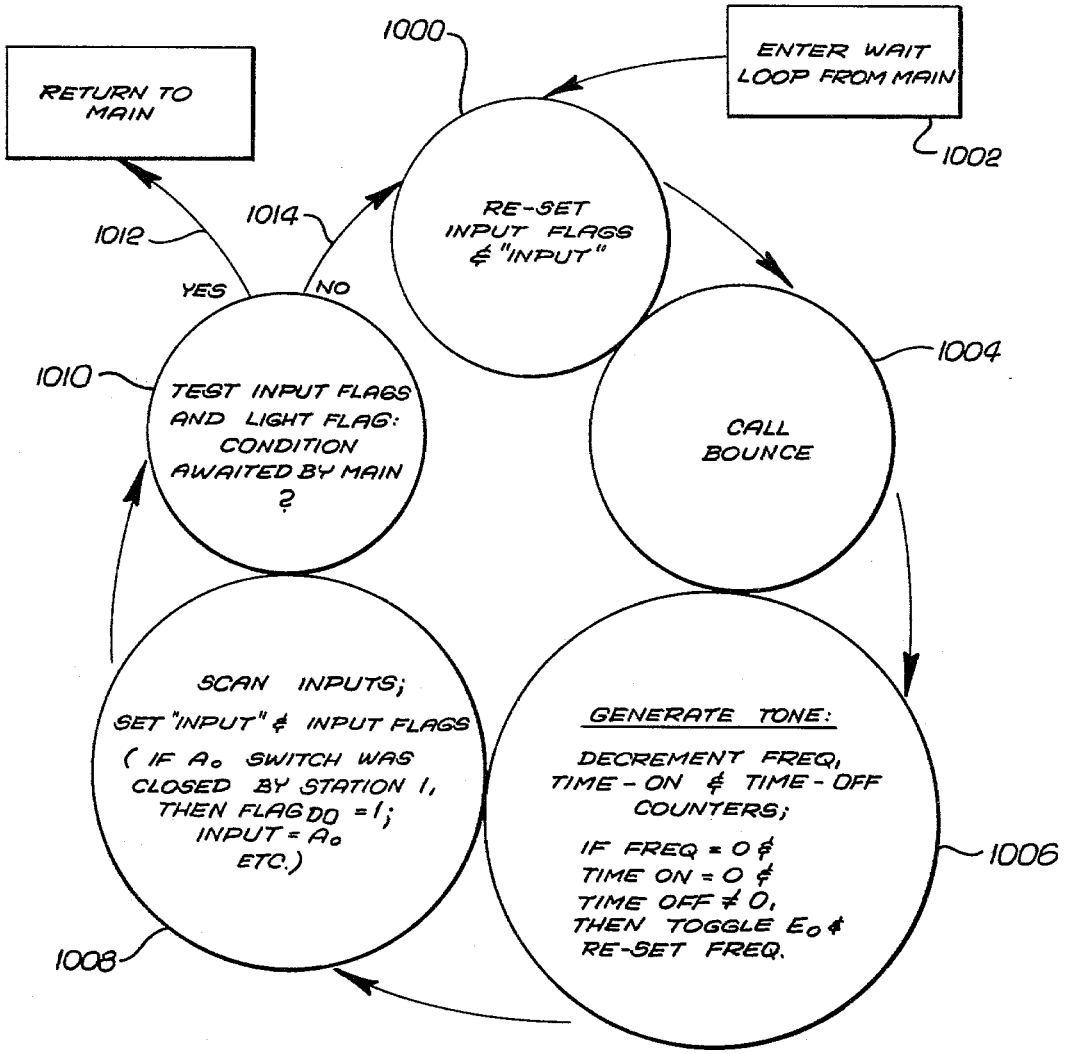
FIG. 10 is a flow chart illustrating the type of "Wait Loop" utilized throughout all three games.

Referring particularly to FIG. 10, it may be seen that the "Wait Loop" previously referred to in connection with Game No. 1 (blocks 166, 176, 186, 208 and 218 of FIG. 7) actually comprises five distinct functions performed in a cyclical sequence. The first of these functions is block 1000 labeled "Reset Input Flags & INPUT". This is the block from which the Wait Loop is always entered from the main program, as indicated by entry branch 1002 labeled "Enter Wait Loop from MAIN". The four flags re-set in block 1000 are four flags respectively associated with Station 1, Station 2, Station 3, and Station 4, and are used to indicate from which of the four stations the current value of INPUT (A0, A1, or A2) was received. Control then passes around the loop to block 1004 labeled "Call BOUNCE". It will be recalled that a single pass through the BOUNCE routine decrements PERIOD (unless the period is already at its LOWEST value) and then either (if CYCLES is less than PERIOD) increments the CYCLES counter by one, or else (if CYCLES is already equal to or greater than PERIOD) increments the Mod 12 counter PHASE, using the new value of PHASE to access a new Bounce Mask for updating the Light Flag and for determining the constants used by the Tone Generator counters, and then re-sets the Tone Generator timing counter.

The BOUNCE sub-routine having been called and the various flags, constants and/or variables updated as necessary, control then passes around the loop to the Tone Generator function represented by block 1006.

As mentioned previously in connection with the detailed description of the BOUNCE routine, the Tone Generator function involves the cycling of timing counters which establish when an audible tone is to commence and when it is to cease (with respect to the beginning of an interval within a bounce of the light cycle), and the cycling and recycling of a Frequency counter which determines the time interval between the successive toggling of the $E_0$ audio output channel associated with loudspeaker 90, thereby generating a musical note of predetermined pitch.

From the Tone Generator function of block 1006, control then passes around the loop to the "Scan Inputs" function of block 1008. Block 1008 scans the Player Station switch inputs one column at a time and, if an input is detected, sets the appropriate Flag to indicate from which station the input was received and, utilizing variable INPUT, records whether the thus detected input was received on line A0, A1, or A2.

From block 1008 control passes around the loop to block 1010 which, it will be noted, is the block within the loop from which control may pass back to the MAIN program via the "Yes" branch 1012. Block 1010 is merely a comparison function, wherein the values of the Input Flags and Light Flag maintained by the Wait Loop (or by the BOUNCE routine called by the Wait Loop) are tested to determine whether or not one of them now assumes the value for which the MAIN program is waiting. If the result of such a comparison is positive, control is transferred out of the Loop via "Yes" branch 1012, otherwise control passes for one more cycle through the Loop via "No" branch 1014 back to the Loop's starting point (block 1000).

Referring now to FIGS. 10*a* and 10*b*, the computer program associated with Game No. 2 will now be discussed in detail. Some of the routines employed by Game No. 2 were discussed in describing the program for Game No. 1 above. In particular, the reader's attention is directed to the above discussion for a detailed description of the BOUNCE subroutine and the RAZZ routine.

In addition to the variables described above, Game No. 2 utilizes a variable R to indicate the direction of rotation of play. It will be recalled that the object of Game No. 2 is to pass the light from one station to the next in either a clockwise rotation or a counterclockwise rotation, the direction of the rotation being randomly selected by the microprocessor at the commencement of the game.

Figure 11A:
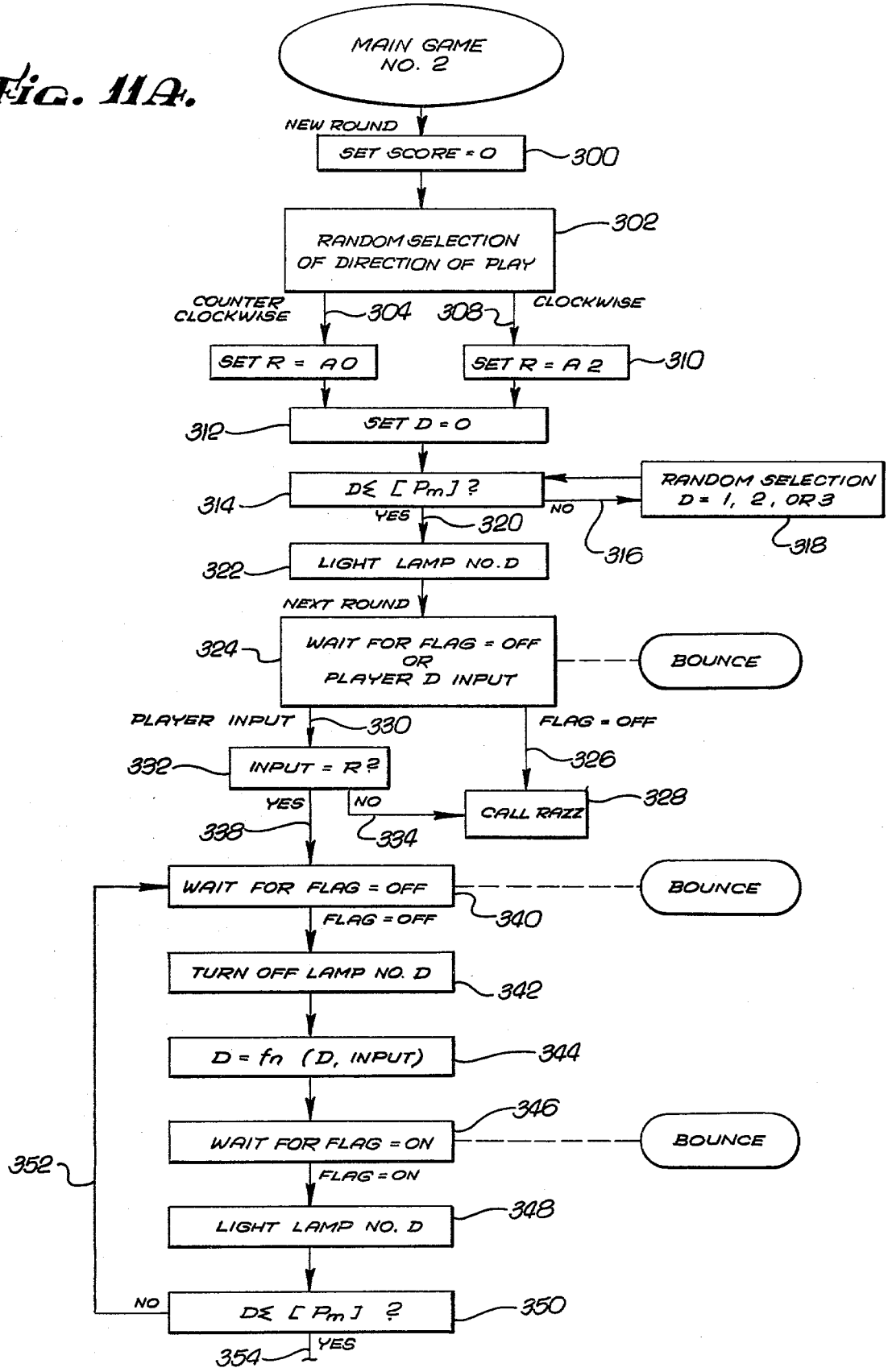
FIG. 11 (comprising FIGS. 11*a* and 11*b*, with flow passing from FIG. 11*a* and FIG. 11*b* as indicated) depicts the MAIN2 Program associated with Game No. 2.

Referring first to the portion of the Game No. 2 MAIN routine shown in FIG. 11*a*, it may be seen that the first function performed is the setting of the variable SCORE to 0 in block 300. The variable SCORE, as in Game No. 1, is meaningful during only the final round or solo mode of play. It is then used to determine whether or not the player has returned 10 passes successfully.

The program proceeds to block 302 wherein the direction of play, clockwise or counterclockwise, is randomly selected. If the counter-clockwise direction is selected control passes via flow-line 304 to block 305 wherein the variable R is set to A0.

Referring to FIG. 4, it will be noted that A0 corresponds to the input selected when a player presses his right control button, designated as numeral 44 for player no. 1. Thus, if the rotation of play is counterclockwise the correct input employed by any player during his turn will be that associated with A0. Likewise, if the direction of play is chosen to be clockwise, control is passed via flow-line 308 to block 310 wherein the variable R is set to A2. Referring to FIG. 4, it will be noted that input A2 corresponds to a player pressing his left control button. In particular reference is made to player no. 1, wherein by pressing his left control button designated as 40, input A2 is activated.

Control passes to block 312 to initialize the variable D to 0. This selects Station no. 1 to initiate play. The program next determines whether D is an active station or an inactive station, in other words, whether there is an appropriate entry in the participation matrix indicating that the player represented by D is in the game. If player D is not in the game, control passes via line 316 to block 318 wherein a random selection is made among players 2, 3 or 4 represented by D=1, 2, or 3. Control is again passed to block 314 to determine once again if the player selected is in the game.

Once an active player has been selected, control is passed via line 320 to block 322 and the light associated with the selected player is lit.

The program will wait in the block labeled "NEXT ROUND," designated by numeral 324, for the player D to insert his input or for the variable FLAG to equal "OFF". It will be noted that the microprocessor is continuously sampling the condition of FLAG and calling the BOUNCE routine at regular intervals while control is in the wait box. If the Light Flag has been turned off, as indicated by the label "flag=off" associated with the flow-line 326, control is passed to block 328 and the RAZZ routine is called. The RAZZ routine is discussed above. It will be noted that at this stage of the game the RAZZ routine serves to update the participation matrix by eliminating those players that have failed to make the proper input.

Figure 11B:
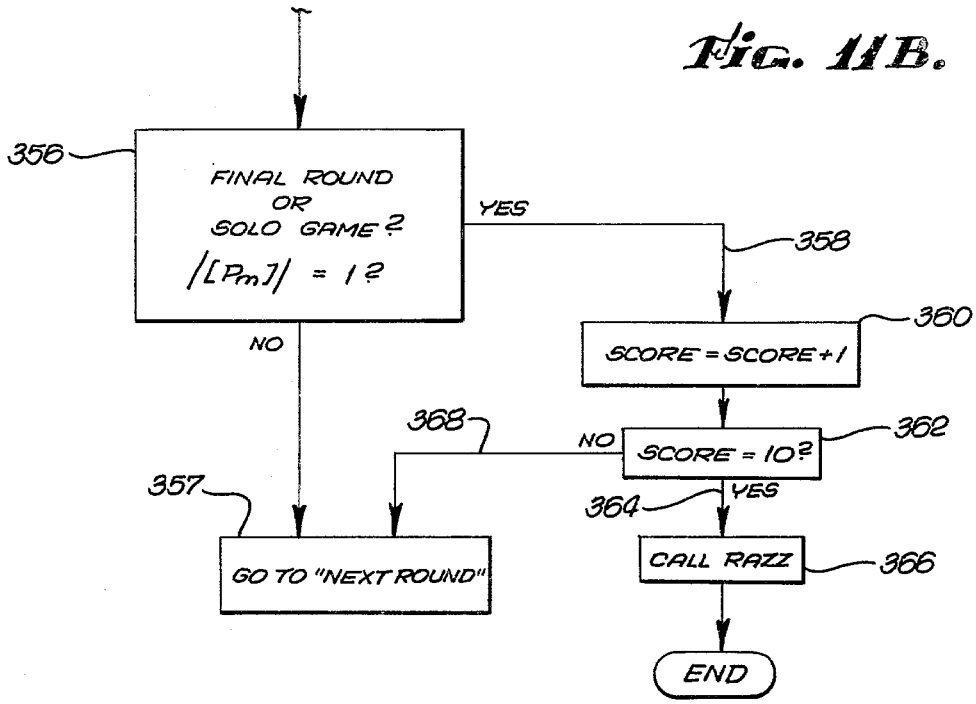

Attention is directed to FIG. 11*b*, wherein it will be seen that if the player D had inserted his input, control would have been passed via the flow-line 330 to block 332. At this point the program compares the input of the player with the variable R. It will be recalled that the variable R indicates the correct input for the particular direction of rotation randomly selected at the commencement of the game. Thus, if the clockwise direction of rotation had been selected, R would have been set equal to A2, and any input by player D other than A2 would cause control to pass along flow-line 334 to block 328. Block 328 calls the RAZZ routine which eliminates the player D from the participation matrix. If the game is in the final round or the solo mode the winner would be determined by the RAZZ routine as described above.

Assuming that the player D has inserted the appropriate input, control is passed along flow-line 338 to block 340. The program will now wait for the Light Flag to be turned "off" by the BOUNCE routine. As explained above, in connection with other wait blocks, the BOUNCE subroutine is called at regular intervals.

Once the Light Flag has been turned off by the BOUNCE routine, control is transferred to block 342, and the light associated with player D is turned off. Block 344 selects a new value for variable D according to the function Fn (D, input) explained above. Note that the parameters of the function are D, which indicates the station of the player who has just inserted his input, and R which indicates the correct input depending upon the rotation of play selected at the beginning of the game. The R parameter is especially important since, as described below, at times the light will be passed from one station to the next even though no input has been inserted. This will be the case whenever the light is passed from an inactive station.

Wait box 346 continuously samples Light Flag and calls BOUNCE at regular intervals. When the Light Flag has been set "On" by the BOUNCE routine, control is passed to block 348 wherein the light associated with player no. D is lit. Control is then passed to box 350 where the new D is compared with the participation matrix to determine whether D is an active station. If D is not an active station, as indicated by the label "No" on flow-line 352, control is passed back to wait box 340. The cycle previously described comprising the "wait, turn light off, select next station, wait, turn light on, and compare new station with participation matrix" is continuously repeated until an active station has been selected. In this manner the microprocessor will automatically pass the light from an inactive station to the next station. Once an active station has been selected, control is passed along the flow-line 354 to block 356 wherein the participation matrix is examined to determine if it contains only one element, as indicated by the "$|[P_m]|=1$" label. If there is more than one player remaining in the game, control is passed to block 357 wherein the routine returns to the box labeled "NEXT ROUND" and the steps previously described are repeated. If only one player remains in the game, indicating either the final round of a multi-player game or a solo game, control is passed along flow-line 358 to block 360 where the variable SCORE is incremented by adding one to the total number of successful passes completed by the solo player. Block 362 determines if the solo player has completed 10 successful passes. If yes, control is transferred along flow-line 364 to block 366 wherein the RAZZ routine is called as described at the end of the MAIN Game No. 1 above. If the one remaining player has not achieved the score of 10, control is passed along flow-line 368 to block 357 wherein the program returns to "NEXT ROUND".

Figure 12B:
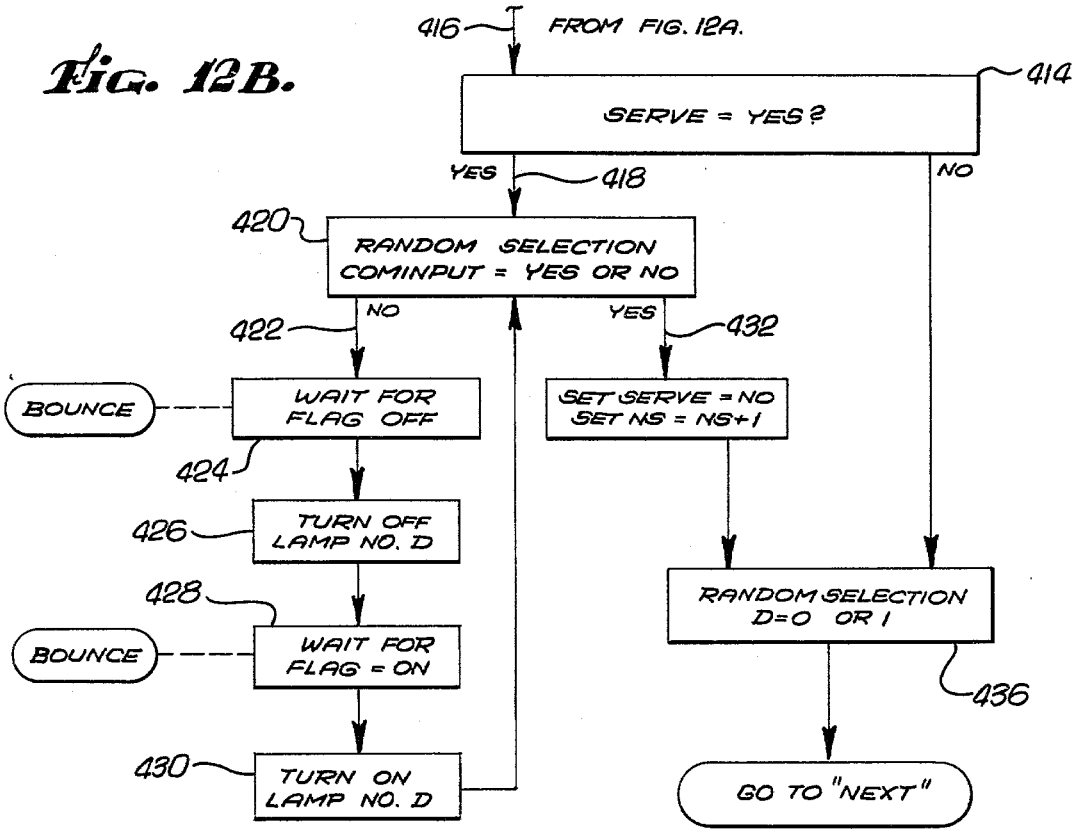
FIG. 12 (comprising FIGS. 12*a* and 12*b*, with flow passing from FIG. 12*a* to FIG. 12*b* as indicated) depicts the MAIN3 Program associated with Game No. 3.
Figure 13:
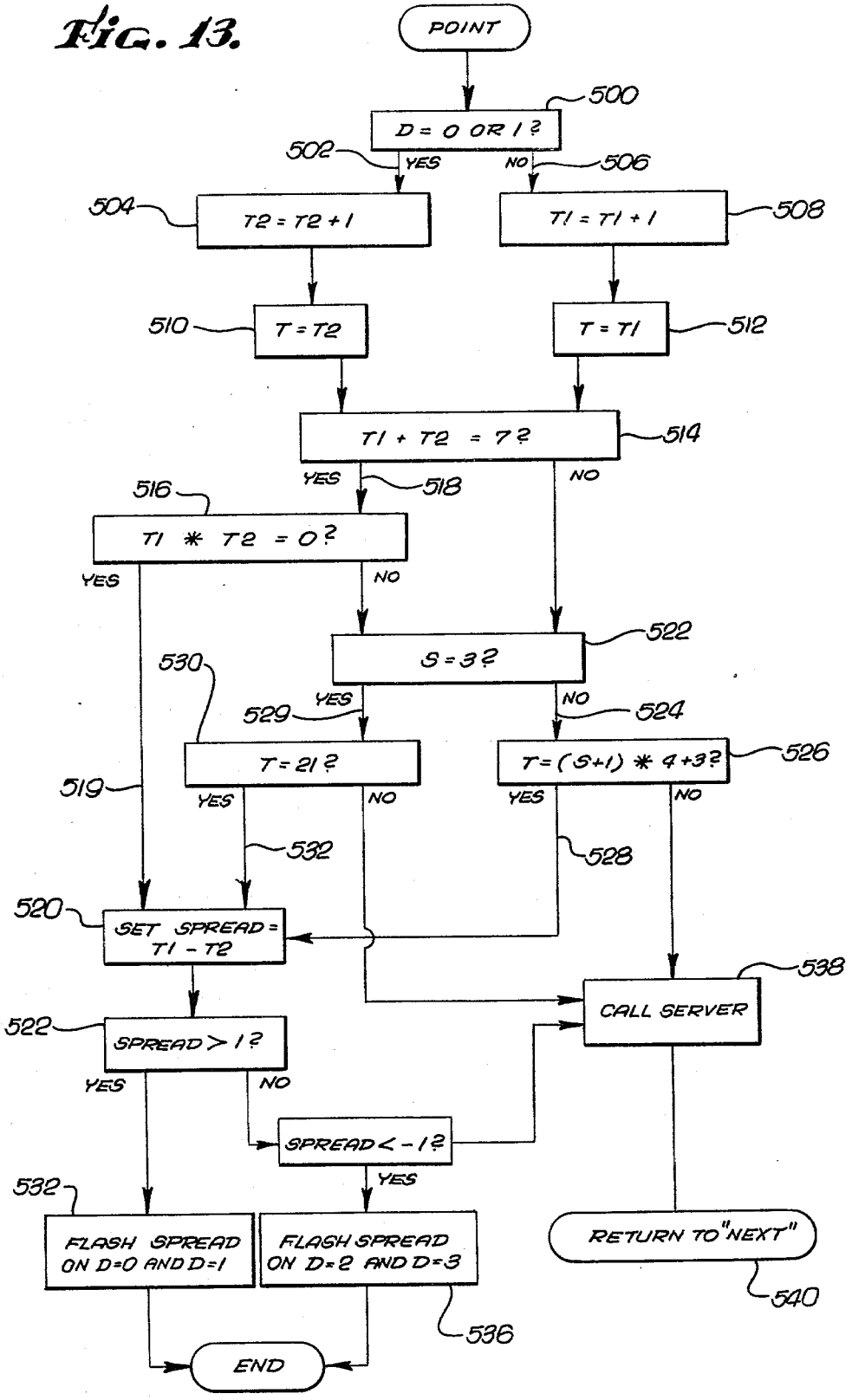
FIG. 13 is a flow chart for the POINT subroutine utilized in Game No. 3.
Figure 14:
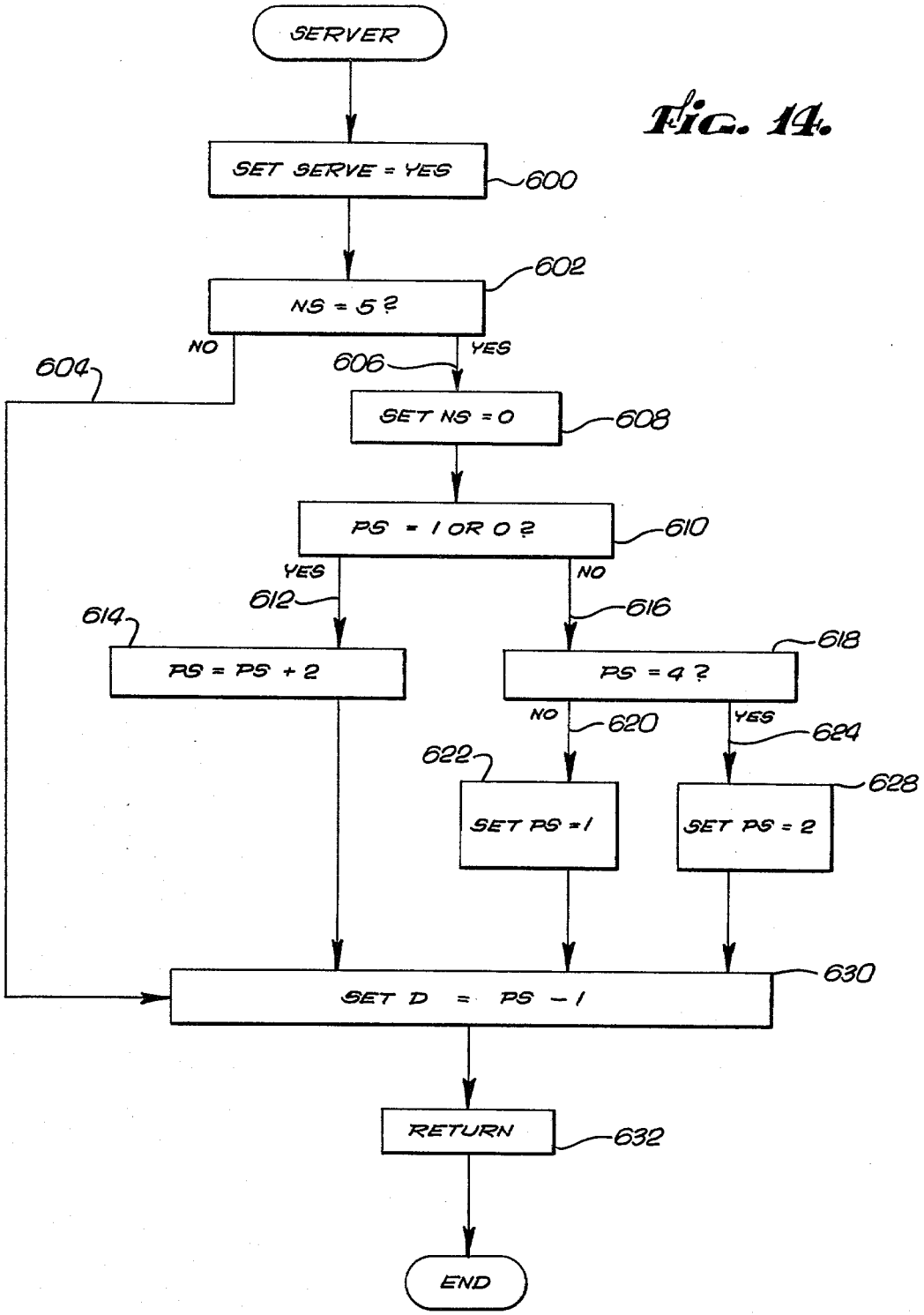
FIG. 14 depicts the SERVER subroutine utilized in Game No. 3.

The computer program associated with Game No. 3 will now be discussed in detail, with particular reference to FIG. 12 (comprising FIGS. 12*a* and 12*b*, and showing the MAIN program for Game No. 3), FIG. 13 (showing the POINT routine that keeps track of the score of both teams) and FIG. 14 (showing the SERVER routine that keeps track of the number of serves taken by each player and indicates which player is to serve at the commencement of any particular point).

In addition to the variables previously described, Game No. 3 includes a few additional variables not in common with Games No. 1 and 2. PS indicates which player is serving and assumes the value 1, 2, 3 or 4. Variable SERVE indicates whether the point is about to be put into play or has already been put into play and assumes the values YES or NO. Variable S indicates the number of serves taken by the player serving and runs from 0 to 5.

Referring first to the portion of the Game No. 3 MAIN routine shown in FIG. 12*a*, it may be seen that the first function performed is the random selection of a player to commence play in block 400. Next, the variables PS, SERVE and S are initialized in block 402. Variable PS is set to D+1. It will be recalled that D equals 0 to refer to player 1; D equals 1 to refer to player 2, etc. SERVE is set equal to YES indicating that the point is about to be put into play. S is set equal to 0, indicating that no serves have been taken by player PS as yet. Control is passed to block 404, wherein the program waits for the Light Flag to indicate that the lamp should be lit. As in all the wait loops, the program periodically calls the BOUNCE routine and continuously samples the variable FLAG. Once the Light Flag is turned "On", control is passed to block 406 and lamp D is lit.

Control then passes to block 408 which determines whether the game is a one player (solo) mode, or, as indicated symbolically "$|[P_m]|=1$" (whether the absolute value of the participation matric equals 1) that is to say, that all entries of the matrix are set to 0 except for a single "one" as previously described. If the game is in the solo mode, then control passes to block 410 via flow-line designated 412 and labeled "Yes." Block 410 tests whether the microprocessor is required to make the next play, that is to say, whether D=2 or 3. If yes, control is passed to block 414 via flow-line 416 labeled "Yes." (See FIG. 12*b*) It will be recalled that a player is required to pass the light during its initial flicker at that player's station unless the player is serving. During the serve, the light is allowed to flash any number of times until the player desires to put the light into play. Therefore, block 414 must determine whether the microprocessor is serving or returning the light. If this particular play is a serve, control will be passed via flow-line 418 labeled "Yes" to block 420 where a random selection of COMINPUT equal to "Yes" or "No" is made. COMINPUT merely indicates whether the processor will input during the present flash of the light, or wait for at least one subsequent flash. If COMINPUT equals "No," the "No" branch indicated by flow-line 422 is taken to transfer control to block 424 which waits for the Light Flag to equal "Off". Once the Light Flag equals "Off," the control is passed to block 426 and light D is turned "Off". Block 428 waits for Light Flag to turn on and then block 430 turns on light D before passing control to the random selection COMINPUT block 420 as previously described. This cycle continues until the microprocessor randomly selects COMINPUT, that is, COMINPUT equals "Yes". When this happens, the "Yes" branch, indicated by flow-line 432 transfers control to block 434 where the number of serves taken by the player serving is incremented by one, and the variable SERVE is set equal to "No", indicating that the next play will be a return rather than a serve. Control then passes to block 436, where a random selection is made as to which station the microprocessor will direct the light, that is, D is set equal to 0 or 1.

If the microprocessor had not been serving, then block 414 would have transferred control directly to block 436 via flow-line 438 labeled "no." The random selection of D=0 or 1 as described would then have been made. Control is then returned to block 404 labeled "Next" and play continues.

Referring again to FIG. 12*a* it can be seen that had the game not been in the solo mode, or had the game been in the solo mode and D not equal to 2 or 3, that is the microprocessor did not have to make the next play, control would have been passed from either block 408 or 410 to block 438. As previously described, it must be determined whether this point is a serve or a return. If this point is a serve, control is transferred via flow-line 440 to wait box 442 where the program waits for either the Light Flag to turn "Off" or an input to be inserted by the player. If the player does not insert an input prior to Light Flag being set to "off," the "Off" branch designated as flow-line 445 transfers control to block 446 wherein the light is turned off. The program waits in block 448 for the Light Flag to equal "On," before passing control to block 450 which turns light no. D on. Control is then passed to block 442 which again waits for either the Light Flag to equal "Off" or an input to be inserted by the player.

Assuming that an input has been inserted by the player, branch 452 labeled "INPUT" transfers control to block 454 wherein the variable S is incremented by 1 and the variable SERVE is set equal to "No."

If this particular point had already been put into play, as indicated by SERVE equals "No," control would have been transferred directly from block 438 to block 456 via flow-line 458. The program then waits for an input to be inserted by player D or for the Light Flag to equal "Off." If FLAG equals "Off" prior to an input being inserted by player D, control is transferred along line 460 to block 462 to call routine POINT. The POINT routine will be further discussed below. Here it is only necessary to point out that by failing to insert an input prior to FLAG being set equal to "Off," player D has lost the point. The POINT routine will award a point to the opposing team, determine if the game has been completed, and transfer control to the SERVER routine which will determine which player is to serve next.

Blocks 466 through 474 determine whether the input inserted by player D is valid, that is, whether the light has been passed to the other side of the game board. Thus, these blocks are accessed both when the player is serving and when the player is returning a point. Control may be transferred to block 466 through flow-line 463 from block 454 if the player D is serving. If the player D is not serving, control is passed from block 456. Block 466 initially determines which side has inserted the input. Thus if D equals 0 or 1, indicating that team 1 has just made the play, branch 468 labeled "Yes" is taken to transfer control to block 470. Block 470 then determines whether the input inserted by team 1 will cause a light corresponding to team 2 to be lit. This is demonstrated by the function Fn (D, input) equaling 2 or 3. If an improper input has been inserted, control is transferred alone line 472 to block 474 which calls the POINT routine. Similarly, if D equals 2 or 3, indicating that team no. 2 had inserted the previous input, control is transferred along line 476 labeled "No" to block 478. Again, an invalid input would have resulted in a transfer to the POINT routine.

If a valid input is inserted, control is passed to block 480 and the program waits until the Light Flag is set equal to "Off." Once this occurs, lamp no. D is turned off at block 482. Control is then passed to block 484 wherein the new D is computed through the use of the function explained above. Control is then returned to the block 404 labeled "NEXT" and the steps described above are repeated.

The subroutines used in connection with the MAIN Game No. 3 routine will now be discussed in detail. In particular, attention is directed to FIG. 13 which depicts a flow chart representing the point routine.

Initially, block 500 determines who has scored the point. The player whose lamp is lit will have been the player who has just lost the point. Therefore, if D=0 or 1, branch 502 is taken from block 500 and the team 2 score is incremented in block 504. Similarly, if team 1 has scored branch 506 is taken and the team 1 score is incremented in block 508. The variable T is set equal to the number of points scored by the team that has just scored the previous point. Thus if team 2 has scored control is passed to block 510 from block 504 and T is set equal to T2. Likewise, if team 1 has just scored, control is passed from block 508 to block 512 and T is set equal to T1.

Once T has been set equal to the number of points scored by the team scoring the previous point, control is passed to block 514 which determines whether the total number of points scored by both teams equals 7. It will be recalled that a "skunk" occurs when one player scored 7 points before the other player has scored. Thus blocks 514 and 516 determine whether a "skunk" has taken place. If the total points scored equals 7 control is passed to block 516 through flow-line 518 labeled "Yes". Block 516 checks the product T1×T2 to determine whether one of the teams has not scored any points. If yes, control is passed along line 519 to block 520 and the game is over. The sequence commencing with block 520 is described below.

If a "skunk" has not taken place, that is to say, if either T1+T2 does not equal 7, or the product T1×T2 does not equal 0, control is transferred to block 522. It will be recalled that the score required to win the game depends upon the skill level selected at the commencement of the game. In particular, at skill level 1, (represented by S=0) the first player to score 7 points wins the game. At skill level 2 (represented by S=1) 11 points are required to win the game. 15 and 21 points respectively are required to win the game of skill levels 3 and 4. For skill levels 1 through 3, the formula "[(S+1)×4]+3" yields the points required for a win; namely 7, 11 and 15. The formula does not work, however, for skill level 4 wherein 21 points are required to win the game. Therefore, block 522 must determine whether the game is in skill level 1, 2 or 3 mode or in skill level 4 mode. If the game is not in the skill level 4 mode (S≠3) then control is transferred via branch 524 to block 426 wherein T is compared with the formula just described to determine if the game is over. If the game is over, control is passed via line 528 to block 520 which will be described shortly.

If the game is in the skill level 4 mode (S=3) then branch 529 is taken from block 522 tansferring control to block 530 wherein T is compared with 21 to determine if the game is over. If the game is over, control is passed through line 532 to block 520. The variable SPREAD is set equal to the difference between the points of team no. 1 and team no. 2 in block 520. This difference in points will be flashed on the lights of the winning team. In order to win the game a team must outscore its opponent by at least 2 points. In order to determine which team, if any, is the winning team, block 522 examines SPREAD to determine if SPREAD is greater or less than one. If SPREAD is greater than one, indicating that team 1 has scored at least two more points than team no. 2, control is passed via branch 531 to block 532 and the difference in score is flashed on the lights of team 1.

If SPREAD is not greater than 1, branch 533 is taken from block 522 transferring control to block 534 wherein SPREAD is tested to determine if it is less than −1. If not control is passed back to block 538 and the game continues.

If SPREAD is less than −1, branch 535 is taken from block 534 transferring control to block 536 wherein the absolute value of SPREAD is flashed on the lights of team no. 2.

If neither of the teams has achieved a winning score, control is passed to block 538 from either block 526 or block 530. The program then calls the SERVER routine which will indicate which player is to serve next. Finally control is passed to block 540 which returns control to the MAIN Game No. 3 routine block 404 labeled "NEXT" for commencement of the next point.

The SERVER routine will now be described in detail. Referring now to FIG. 14, a flow chart representing the program associated with the SERVER routine is depicted.

The SERVER routine is called only after a point has been scored and it is always called before the beginning of a new point after the initial serve of the game.

Initially, block 600 sets the variable SERVE equal to "Yes" indicating that the next play will be a serve and not a return. It will be recalled that each player is entitled to five serves in succession before the serve is transferred to a player of the opposing team. Therefore block 602 must determine if the player seving has taken all five of his allotted serves. If not, the "No" branch is taken indicated by flow-line 604 and the routine returns to the POINT routine where, as described above, control is transferred to the MAIN program of Game 3 at the block labeled "NEXT".

If NS does equal 5, indicating that the number of serves taken by the player equals 5, control is passed via flow-line 606 to block 608 where the variable NS is equal to 0.

The program must now determine which player will serve next. It will be recalled that the teams serve alternately. The precise order of serve is not important so long as the serve always transfers from one team to the other. The arbitrary order of player 1, player 3, player 2, player 4, has been selected for use in this program.

Block 610 determines whether team 1 or team 2 had been serving. If team 1 had been serving, as indicated by PS equals 1 or 2, the "Yes" branch indicated by flow-line 612 is taken to transfer control to block 614. The variable PS is then incremented by 2, it can be seen that in this way player 3 will follow player 1 and player 4 will follow player 2 in serving rotation.

If the player serving had been a member of team no. 2, the "No" branch indicated by flow-line 616 would have been taken transferring control to block 618. The program determines if the player serving had been player no. 3 or player no. 4. If player no. 3 had been serving, the "No" branch indicated by flow-line 620 is taken, transferring control to block 622 wherein the new player serving, PS, is set equal to 1.

If the player serving had been player no. 4, the "Yes" branch indicated by flow-line 624 is taken, transferring control to block 628 wherein the player serving is set equal to 2.

Once the next player to serve has been determined, control is transferred to block 630 wherein D is set equal to PS-1. It will be recalled that PS equals 1 for player serving no. 1 wherein D equals 0 to represent the light at the station of player no. 1. Control is then passed to block 632 and the routine returns to the point routine which transfers control to the MAIN Game No. 3 routine at the block labeled "NEXT" as previously described.

Thus, there has been illustrated and described in detail a presently preferred embodiment of game apparatus which is believed to fulfill all of the objects and advantages sought therefor. It should be understood that many changes, modifications, variations, and other uses and applications of the described apparatus will become apparent to those skilled in the art after considering this specification and the accompanying drawings. Therefore, any and all such changes, modifications, variations, and other uses and applications which do not depart from the nature and spirit of the invention are deemed to be covered by the invention which is limited only by the following claims.

What is claimed is:

1. Apparatus for playing a game of skill adapted for concurrent use by up to at least three players, said apparatus comprising:

a. game start means for causing the commencement of a game round;

b. at least three player control stations, each of said stations adapted for operation by a separate player and comprising:

(1) designating means for designating to the players which one of said stations is "active"; and (2) actuating means actuatable by the station's respective player for permitting said player to select a particular other one of said stations; and c. electronic game control means for (1) operating the respective ones of said designating means, (2) determining whether a particular actuation of a particular station's said actuating means is "proper", and (3) for responding to the proper actuation of said actuating means at a particular active station by causing the thereby selected station thereupon to become the active station.

2. The apparatus of claim 1 further comprising:

d. electronic timing means for determining when a particular actuation of said actuating means at an active station is a "timely" actuation and when it is an "untimely" actuation; and e. signal means responsive to said timing means for generating a signal perceivable to the player at the active station for indicating whether the actuation of the station's actuating means would then be timely or untimely; and wherein said game control means additionally responds to the untimely actuation of an active station actuating means by thereupon terminating the current game round.

3. The apparatus of claim 2, wherein said electronic timing means further comprises skill level means for establishing a predetermined percentage of time such actuation is "timely", as distinguished from "untimely".

4. The apparatus of claim 3 further comprising skill select means for selecting a particular one of a plurality of different predetermined percentages to be said percentage established by said skill level means, a higher such percentage requiring a lower measure of skill.

5. The apparatus of claim 2, wherein a visible light is associated with each of said player control stations, functioning as said designating means for its associated station by flashing on and off when the station is active, and as said signal means by remaining on while actuation of the station's actuating means would be timely and remaining off while actuation of said actuating means would be untimely.

6. The apparatus of claim 2, wherein said game control means, in response to such untimely actuation of the actuating means at an active station:

a. renders the then active station "disqualified";

b. treats any attempt in a subsequent game round to select the thus disqualified station by the corresponding actuation of the actuating means at an active station "improper"; and c. thereupon terminates said subsequent game round.

7. The apparatus of claim 6, wherein said game control means, in response to such "improper" actuation of the actuating means at a subsequent active station, renders said subsequent active station "disqualified" and no longer capable of participating during further rounds of play in the same game.

8. The apparatus of claim 1, wherein:

a. said at least three stations are arranged in a closed loop such that each station has a single station to its immediate left and a single station to its immediate right;

b. the designation of the active station revolves from one station to the next along said loop, in a clockwise direction for a clockwise round and in a counterclockwise direction for a counterclockwise round;

c. said game start means further comprises direction means for establishing whether a given round of a game is to be a "clockwise" or a "counterclockwise" round; and d. a proper actuation must select the station to the active station's left if the current game round is a clockwise round, and of the station to the active station's right if the round is a counterclockwise round.

9. The apparatus of claim 8, wherein in a clockwise round said actuating means permits the respective player at a given station to select only the station to the player's left.

10. The apparatus of claim 8, wherein said actuating means in each round permits the respective player to select either the station to the player's left or the station to the player's right.

11. The apparatus of claim 8, wherein all rounds of a game are in the same direction.

12. The apparatus of claim 8, wherein said direction means establishes the direction of each round within a game independently and in a random or apparently random fashion.

13. Apparatus for playing a game of skill, said apparatus comprising:

a. at least two stations b. means for sensing a physical player response;

c. signal means for generating a visible signal at a varying one of said stations for indicating which one and only one of said stations was then "active", and having an "on" condition and an "off" condition for indicating to any participating player associated with the then active station whether respectively a physical response by said player would then be "timely" or "untimely";

d. timing means for establishing a regular tempo comprised of measures of predetermined duration regularly following one another in succession;

e. flashing means responsive to said timing means for causing said signal means to change said signal to its "on" condition at a first predetermined point within each of said measures and for causing said signal means to change said signal to its "off" condition at a second predetermined point within each of said measures;

f. game control means for determining whether a player response at an active station occurred while said signal was in its "on" or "off" condition and thereupon rewarding or penalizing the player at said station in accordance with the rules of the game.

14. The apparatus of claim 13 wherein:

said apparatus further comprises a third station;

said means for sensing a response further comprises a set of switches at each of said stations manually actuatable by an associated player to permit said player to select a particular other one of said stations; and said game control means further responds to the proper actuation of said switches at a particular active station by causing the thereby selected station thereupon to become the active station.

15. The apparatus of claim 14 wherein said game control means further responds to the untimely actuation of an active station switch by thereupon terminating the current game round.

16. The apparatus of claim 15 when said game control means further penalizes the player not responding at an active station while said signal was in its "on" condition by disqualifying said player from further rounds of play in the same game.

17. The apparatus of claim 13 wherein said rules of the game require that the station to be selected by a player at an active station always be the station at a predetermined random direction around a closed loop of stations for each round.

18. The apparatus of claim 13 wherein said flashing means further comprises skill select means for selecting a particular one of a plurality of different predetermined percentages that said visible signal is in its "On" condition, a higher such percentage requiring a lower measure of skill.

19. The apparatus of claim 13 wherein an electric light is located at each of said stations for displaying said visible signal to the players.

20. The apparatus of claim 19 wherein said game of skill is "pass around the circle".

21. The apparatus of claim 19 wherein said game of skill is "pass to anyone".

22. The apparatus of claim 13 further comprising:

g. acceleration means for speeding up said tempo within a single round of a game by shortening the pre-determined duration of later ones of said measures with respect to earlier one of said measures.

23. The apparatus of claim 13 further comprising:

g. tone generator means responsive to said timing means for generating a rhythmic sequence of musical tones in synchronization with the flashing on and off of said visible signal.

24. The apparatus of claim 23 wherein said tone generator means is further provided with means for delaying by a predetermined amount the start of a particular musical tone within said rhythmic sequence relative to the beginning of a particular interval within successive said measures whereat said signal is changed to its said on condition.

25. The apparatus of claim 23 wherein said flashing means further comprises skill select means for selecting a particular one of a plurality of different predetermined percentages that said signal is in said on condition and wherein said tone generator generates a different such rhythmic sequence corresponding to each of said skill levels.

26. Apparatus for playing a simulated game of table tennis, said apparatus comprising:

a. a simulated ball with four distinct associated fixed locations, each of which having an active state with the ball visible and an inactive state with the ball invisible, the first two of said simulated ball locations constituting a first team and the second two of said simulated ball locations constituting a second team;

b. serving means associated with said first team for selectively causing one or the other of said second team ball locations to assume its ball visible state;

c. first manually actuatable response means associated with the first simulated ball location of said second team;

d. second manually actuatable response means associated with the second simulated ball location of said second team;

e. electronic timing means for activating successive ones of said locations during a rally within a game, the active location regularly alternating from team to team in accordance with a regular "bounce" tempo; and f. electronic scoring means for determining during each such rally whether each of said manual response means was actuated while its associated ball location was in its active state and for controlling the progress of the game accordingly.

27. The apparatus of claim 26, wherein said first team and said second team are visibly designated at the commencement of a game by the simultaneous activation of the first and second ball locations of said first team, alternating with the simultaneous activation of the first and second ball locations of said second team.

28. The apparatus of claim 26, wherein:

said first manually actuatable response means and said second manually actuatable response means additionally function as a second serving means associated with said second team, said first serving means associated with said first team further comprises a third manually actuatable response means associated with the first simulated ball location of said first team, and a fourth manually actuatable response means associated with the second simulated ball location of said first team, said first and second manual actuatable response means may manually select either the first or the second simulated ball location of said second team, and said third and fourth manually actuatable response means associated with said first team may manually select either the first or the second simulated ball location of said first team.

29. The apparatus of claim 28, wherein said first and second serving means each further comprises serving bounce means for selectively causing one or the other of the associated team ball locations to be regularly activated in accordance with said regular bounce tempo, and serve detection means for determining when the particular one of said manually actuatable response means associated with such regularly activated serving ball location was actuated while said serving ball location was in its active state.

30. The apparatus of claim 26 wherein said serving means is under automatic program control, and wherein said selectively causing is performed automatically in a random or apparently random manner.

* * * * *